US011202969B2

(12) United States Patent
Kaye

(10) Patent No.: US 11,202,969 B2
(45) Date of Patent: Dec. 21, 2021

(54) CONSTRUCTION TOY WITH INTERCONNECTING STRIPS AND RINGS

(71) Applicant: George Fenwick Kaye, Shanghai (CN)

(72) Inventor: George Fenwick Kaye, Shanghai (CN)

( * ) Notice: Subject to any disclaimer, the term of this patent is extended or adjusted under 35 U.S.C. 154(b) by 0 days.

(21) Appl. No.: 16/689,675

(22) Filed: Nov. 20, 2019

(65) Prior Publication Data

US 2020/0155956 A1 May 21, 2020

Related U.S. Application Data

(60) Provisional application No. 62/769,910, filed on Nov. 20, 2018.

(51) Int. Cl.
*A63H 33/10* (2006.01)

(52) U.S. Cl.
CPC ..... *A63H 33/102* (2013.01); *A63H 33/108* (2013.01)

(58) Field of Classification Search
CPC ..... A63H 33/102; A63H 33/108; A63H 33/12
USPC ..... 446/53, 85, 95, 96, 105, 106, 107, 108, 446/115, 122, 124, 126
See application file for complete search history.

(56) References Cited

U.S. PATENT DOCUMENTS

| | | | | |
|---|---|---|---|---|
| 1,309,240 | A | 7/1919 | Chappuis | |
| 1,975,038 | A | 4/1933 | Cavanagh | |
| 1,915,835 | A | 6/1933 | Pajeau | |
| 2,088,128 | A | 7/1937 | Benjamin | |
| 2,093,341 | A * | 9/1937 | Reiche | A63H 33/102 446/104 |
| 2,208,049 | A | 7/1940 | Pajeau | |
| 2,461,465 | A | 2/1949 | Chu et al. | |
| 2,625,769 | A | 1/1953 | Hubbard | |
| 2,844,910 | A * | 7/1958 | Korchak | A63H 33/06 446/106 |
| 3,518,787 | A | 7/1970 | Anello, Sr. et al. | |
| 3,975,858 | A | 8/1976 | Much | |

(Continued)

FOREIGN PATENT DOCUMENTS

| | | |
|---|---|---|
| CN | 204017392 | 12/2014 |
| WO | WO9818533 | 5/1998 |

OTHER PUBLICATIONS

ArtSpring, "Bamboo Handcraft/doo+vibe", Jun. 25, 2017.
ISA/US, "International Search Report for PCT/US2019/062426", dated Jun. 4, 2020.

*Primary Examiner* — Nini F Legesse
(74) *Attorney, Agent, or Firm* — James F. Lea, III; Gable Gotwals

(57) ABSTRACT

The invention is a construction toy consisting of standard connector elements, e.g., rings, and strut elements, e.g., that may be joined in various angular configurations and with various types of articulation such as fixed, sliding, swinging, spinning, etc. Rings may be provided that have pairs of perimeter orifices that are offset by different amounts wherein the different offsets provide different functionality to ring and strut assembles. Other elements may be included such as pipes, slips, caps, base components and collar components. The elements may be combined to create various forms including a figure with human traits comprised of interconnecting strips and rings of various dimensions, a decoration, a vehicle, a bird, or many other forms in accordance with a user's imagination.

20 Claims, 24 Drawing Sheets

(56) References Cited

U.S. PATENT DOCUMENTS

| | | | | | |
|---|---|---|---|---|---|
| 3,987,579 | A | * | 10/1976 | Palenik, III | A63H 33/108 446/118 |
| 3,998,002 | A | | 12/1976 | Nathanson | |
| 4,182,072 | A | | 1/1980 | Much | |
| 4,273,537 | A | | 6/1981 | Borisof | |
| 4,326,354 | A | * | 4/1982 | Hagberg | A63H 33/108 446/126 |
| 5,013,245 | A | * | 5/1991 | Benedict | G09B 1/10 434/113 |
| 5,310,376 | A | * | 5/1994 | Mayuzumi | A63H 33/04 446/107 |
| 5,562,519 | A | | 10/1996 | Loewenton | |
| 6,231,416 | B1 | | 5/2001 | Clever et al. | |
| 6,443,797 | B1 | | 9/2002 | Liu | |
| 7,223,207 | B1 | * | 5/2007 | Basyuk | A61H 7/001 482/114 |
| 7,371,146 | B2 | | 5/2008 | Scarborough | |
| 7,374,468 | B2 | | 5/2008 | Flodin et al. | |
| D570,923 | S | * | 6/2008 | Vazquez Gastellu | D21/345 |
| 7,854,044 | B1 | * | 12/2010 | Tillitski | F16G 11/05 24/122.6 |
| 7,985,115 | B2 | | 7/2011 | McCloskey | |
| 8,403,327 | B2 | | 3/2013 | Fischer et al. | |
| 9,895,623 | B2 | | 2/2018 | Cochella | |
| 2009/0205997 | A1 | | 8/2009 | Richards et al. | |
| 2013/0108355 | A1 | | 5/2013 | Lee | |

* cited by examiner

CONSTRUCTION TOY WITH INTERCONNECTING STRIPS AND RINGS

CROSS REFERENCE TO RELATED APPLICATIONS

This application claims the priority of U.S. Provisional Patent Application No. 62/769,910 titled "CONSTRUCTION TOY WITH INTERCONNECTING STRIPS AND RINGS," filed Nov. 20, 2018, the contents of which are hereby incorporated by reference.

FIELD OF THE INVENTION

The invention relates to toys. More particularly, the invention is a construction toy consisting of various pieces that may be assembled and disassembled to create many different imaginative forms. The invention addresses the problem of satisfying the complex criteria for a useful construction toy through a new system of connecting parts.

BACKGROUND OF THE INVENTION

Construction toys offer users a framework for exploring materials, expressing creative ideas and developing many important skills. Construction toys share in common the requirement that individual pieces may be joined together to build composite forms. The invention may be considered among a category of "strut and connector" construction toys (or "rod and connector"), in which flexible or rigid strut elements are joined to connector elements resulting in lattice-like forms.

At least three inter-related criteria are important to a user's experience of a construction toy. First, the pieces should be able to be manually joined easily and durably, yet also easily taken apart without pieces breaking. A set of basic wooden blocks is an example. Most construction toy systems involve joints that are more durable than stacked wooden blocks. How durable and how easily assembled/disassembled a toy should be is relative to each user's skill level, appetite for challenge and other variables. Ideally, a toy provides a range of experiences that may satisfy users of different dispositions and skill levels.

Second, the pieces should be able to be combined so as to construct multiple forms. In other words the toy overall should be versatile. "Strut and connector" type toys typically include connector elements with multiple connection points thus allowing for a range of choices of orientation of the struts. They typically include a limited number of different elements, including struts of different fixed lengths, shape and/or color.

Third, the constructible composite form(s) should be compelling. What constitutes "compelling" is of course subject to changing standards and individual preference. A form may be compelling because it achieves a degree of realism, has complex moving parts, has life-like qualities, is simply an original design, or has some combination of these or other qualities.

The interplay between these criteria is complex, with evident trade-offs. For example, realism may be achieved with specialty elements, but at the expense of versatility. The invention encompasses several innovations that address certain limitations of existing "strut and connector" type toys, mitigating some related trade-offs.

One such limitation relates to the choices available at a given joint for the articulation of the parts. Articulation refers to the action of the parts where they come together.

For example, a joint may consist of a round hole on the connector element into which a cylindrical strut element is fitted and tightened frictionally. At this joint the two parts are immobile, joined tightly to one another. They cannot also slide across one another, or rotate around one another at this joint. At a given joint in a construction form, either the strut or the connector element must be changed in order for a different kind of articulation to be achieved. Standard elements that could be joined with several choices of articulation would afford greater overall form possibilities for toy sets with an equal number of pieces.

A second related limitation arises from the fixed length of the strut elements. With fixed strut lengths, the distance between joints must conform to the dimensions of the struts provided. Standard struts whose length could be edited would provide greater overall form possibilities. Users would have greater choice of distance between joints, and would be able to use any strut in the toy set for any application.

A third limitation relates to tradeoffs between structural strength and flexibility of the struts. The thinner a strut the more easily it may bend and/or twist, but the more breakable it may become. Thick, rigid struts on the other hand may provide structural strength but limit the possible achievable forms (i.e. limit the toy's versatility). This tradeoff may be mitigated somewhat with tube-shaped struts that are both flexible and strong. Tube-shaped struts have the disadvantage that they cannot present flat against one another or against other attachments however, limiting their aesthetic appeal in certain applications as well as their usability. A strut system using rectilinear struts that have a high degree of flexibility as well as strength when needed could reconcile these apparent trade-offs.

SUMMARY OF THE INVENTION

In addressing the above listed and other limitations, the invention gives users opportunities to create diverse, compelling forms of their own design with relative ease. The invention as a whole challenges the user with a unique system of conventions for constructing forms, and within this system a limitless field of possibilities.

The invention is a construction toy consisting of standard connector elements ("rings") and strut elements ("strips") that may be joined in various angular configurations and with various types of articulation (e.g. fixed, sliding, swinging, spinning etc.). The toy is currently produced entirely of bamboo, which is suited for Applicant's joint system and flexibility of the strips provided by this material. However, the system as described below may be constructed of other types of material.

Strips

The strips are long, rectilinear elements. In one embodiment, the strips have a width that is proportionate to their thickness such that for a given circle with radius r two strips stacked flat end-to-end present a rectangular profile at the end that may be inscribed within the circle (FIG. 1C). In one embodiment, the strips are half as thick as they are wide, such that two strips stacked flat end-to-end present a square profile at the end. The strips can flex into a curve that can be held in tension. The strips may also be worked into shallow curves that retain their shape without tension. The strips may be of a single standard length that optimizes functionality and safety. The strips may be scored at regular intervals on one of the wide faces such that a strip can be easily broken at a score, and thus edited to shorter lengths (FIGS. 4 & 5). When flexed into a curve with the scores facing outwards (e.g. away from the radius of the curve), a strip will break easily. The breaking point can be controlled by the fingers, or by passing the strip through a hole in a ring and using the ring as leverage (useful especially for breaking off end segments). When flexed with the scored side facing inwards (e.g. towards the radius of the curve) the strip stays intact. The strips may also feature a small "v" fork on both ends and an incision at the base of the fork allowing for two sides of the fork to come apart at the ends. In this way, a string or thin slip may be wedged tightly in between the two sides of the fork at the end of a strip. A string thus attached may function as a connector to another strip similarly attached, or to an anchor from which a form is suspended (FIG. 6). A thin slip may serve as a wedge that prevents the strip from sliding through holes in a connector element.

Rings

The rings are cylindrical with a hollow center, of several standard diameters. A plurality of holes on the sides of each ring are aligned such that a strip can pass through two holes, crossing inside (e.g. cross-cutting the cylinder). In one embodiment, the holes are sized to circumscribe two strips stacked flat against one another. In this configuration, the strips fit tightly into the holes and together provide greater structural strength than that of a single strip (FIG. 8). A single strip will slide freely through the holes. In this configuration, the ring will spin freely around the strip when the strip is held secure.

Rings with smaller diameters can be fitted into the hollow of rings with larger diameters, and the central axis of the smaller ring can be rotated relative to the central axis of the larger ring. Strips may be passed through holes of such concentric rings securing them in place. In this way, a wheel-and-axle type joint may be achieved (FIG. 24), as well other useful combinations.

Offset Holes

An important feature of the rings is an offset in the alignment of certain holes from other holes on some rings. Two holes are aligned when the lines representing the shortest distance between their centers and the central axis of the cylinder intersect (FIG. 7). When two holes are offset, these lines do not intersect, and the distance between these two lines along the central axis is the offset distance (FIGS. 12, 16, 19). When two or more strips are crossed, each passing through different holes on the ring, they interact differently depending on the diameter of the ring, the offset distance between their respective holes, and the orientation of the strips. Specifically, the strips may frictionally lock one another in place, slide freely against one another but not spin, or spin freely. Detailed descriptions of several example configurations of crossed strips and the method for calculating their offset distances are given below.

Pipes

Pipes are cylindrical elements. In one embodiment, their diameter is equal to the width of the strips. Like the strips, the pipes may have a small "v" fork on both ends and an incision at the base of the fork allowing for two sides of the fork to come apart at the ends (FIGS. 27A, 27B). In this way a string or thin slip may be wedged tightly in between the two sides of the fork at the end of a pipe.

Slips

Slips are rectilinear elements of similar length to the strips. In one embodiment, their width is equal to the diameter of the holes on the rings and thickness small enough that they may fit tightly through the holes, adjustable with a force easily exerted by a user. The slips may be broken and edited to shorter lengths. Owing to their smaller thickness, the slips have greater flexibility than the strips and can be useful for tying rings together, creating loops with a small radius and other applications (FIGS. 30, 31A, 31B).

Caps

Caps are the same as rings in all respects except that they contain a wall such that they are not hollow all the way through their axis. The wall features an orifice at its center through which a single strip may tightly fit, thus enabling another kind of wheel-and-axle type joint (FIG. 32).

Base Components

Base components are rectilinear elements of various dimensions that can preferably be joined together in parallel or end-to-end to create a base for anchoring standing forms. They feature a plurality of through-holes with diameter equal to the width of the strips, such that a single strip can be frictionally secured in a hole (FIGS. 34A, 34B).

Collar Components

Collar components are hollow cylindrical elements of various dimensions that can slide along a single strip, but are frictionally tight. They are useful for holding other elements in place along a strip that are not themselves frictionally tight. Where a collar component is of sufficient length, it may also function as a connector element, joining strips end-to-end. Collar components may also feature one or more perimeter holes through which a strip may pass, thereby connecting strips in perpendicular (FIG. 38C).

In combination, these features allow for a great range of joining possibilities and possible resulting forms.

As an example, the elements described herein may be combined to create various forms including a figure with human traits comprised of interconnecting strips and rings of various dimensions, a decoration, a vehicle, a bird, or many other forms in accordance with a user's imagination.

BRIEF DESCRIPTION OF THE DRAWINGS

Strips

Rings

Figure 7:
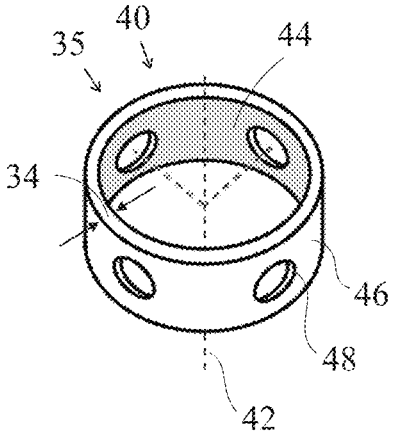

FIG. 7 is a perspective view of a ring defining holes on a perimeter of the ring, a central axis and lines representing the shortest distance from the center of the holes to the central axis.

Figures 1A, 1B, 1C:
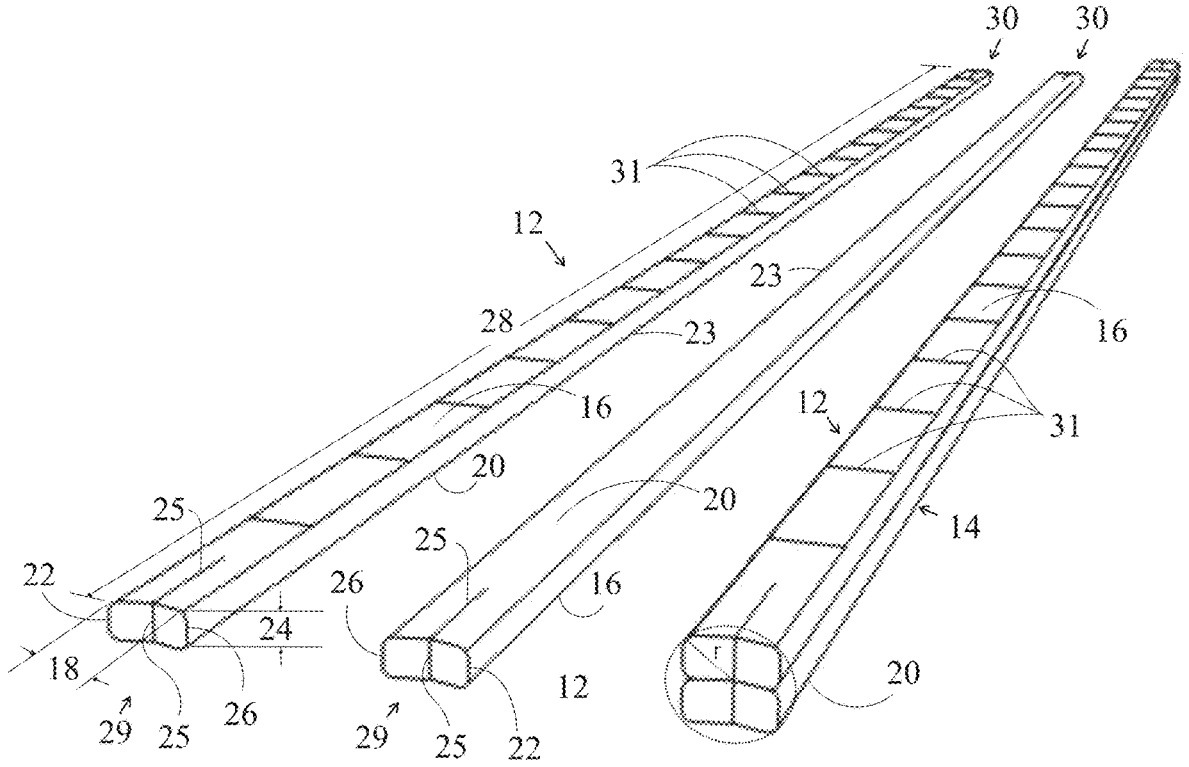
FIG. 1A is a top perspective view of a strip having scoring on a top surface.
FIG. 1B is a bottom perspective view of the strip of FIG. 1A showing scoring on a bottom surface.
FIG. 1C is a perspective view of the strip of FIGS. 1A and 1B and a second strip stacked together.
Figure 8:
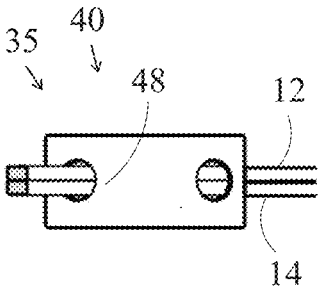

FIG. 8 is an elevation view of the ring of FIG. 7 showing the two stacked strips of FIG. 1C passing through holes and held in friction.

Figure 9:
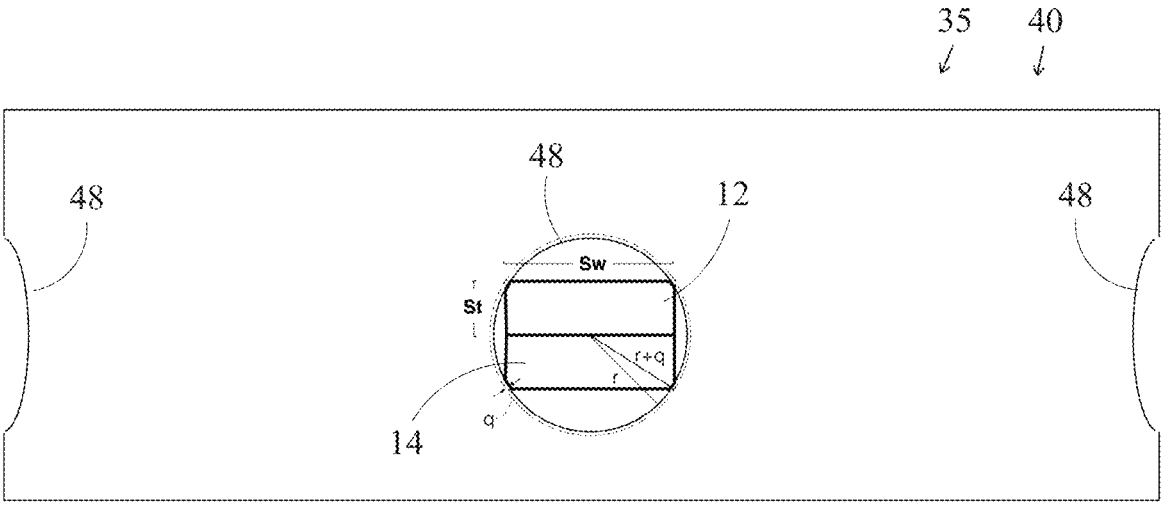

FIG. 9 is an enlarged elevation view of the ring of FIG. 7 showing the two stacked strips of FIG. 1C passing through holes and held in friction.

Figure 10:
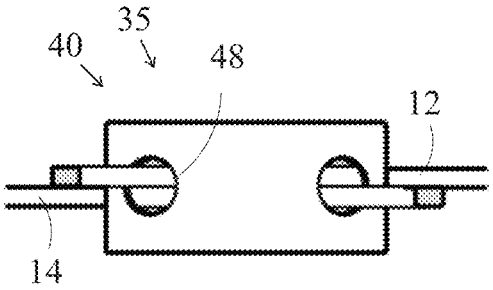

FIG. 10 is an elevation view of a ring with no-offset holes showing two strips of FIG. 1A-1C passing through different holes, crossing inside the ring, and held in friction.

Figure 11:
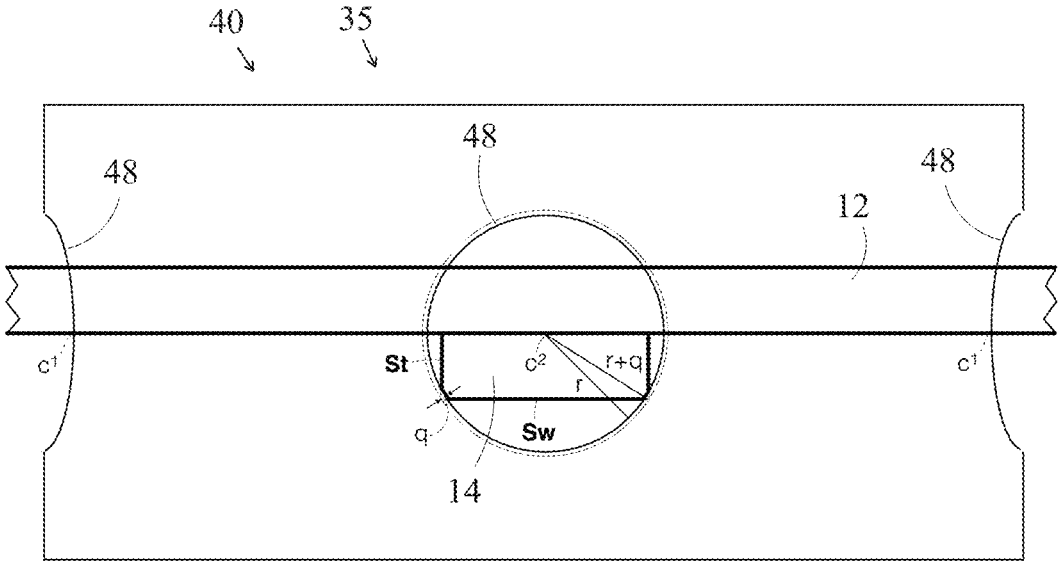

FIG. 11 is an enlarged elevation view of the ring and strips of FIG. 10, showing a detail of two strips of FIG. 1A-1C crossing inside the ring.

Low-Offset Holes

Figure 12:
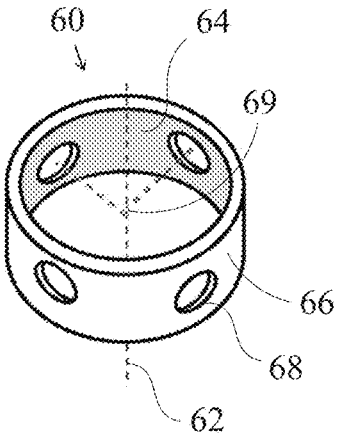

FIG. 12 is a perspective view of a ring with low-offset holes that have an offset distance that is a minimum distance necessary for a user applying force with easy effort to pass the strip of FIG. 1A and FIG. 1B through different holes and crossing inside the ring, with one strip rotated such that the narrow side of one strip interfaces with the bottom surface or wide side of the other, holding both in friction, and showing a central axis of the ring and lines representing the shortest distance from the center of each hole to the central axis.

Figure 13:
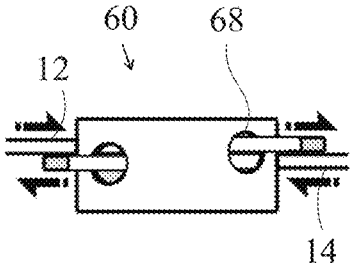

FIG. 13 is an elevational view of a ring with low offset ring, showing the strip of FIG. 1A and FIG. 1B passing through different holes and crossing inside the ring in light contact, which permits sliding action of the strips indicated by arrows.

Figure 14:
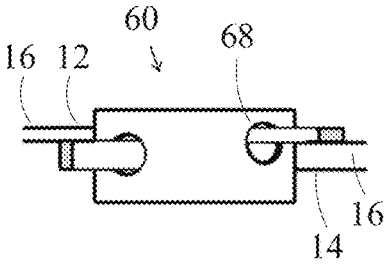

FIG. 14 is an elevational view of a ring with low offset holes, showing the strip of FIG. 1A and FIG. 1B passing through different holes and crossing inside the ring, with one strip rotated such that the narrow side of one strip interfaces with a bottom surface or wide side of the other, holding both in friction.

Figure 15:
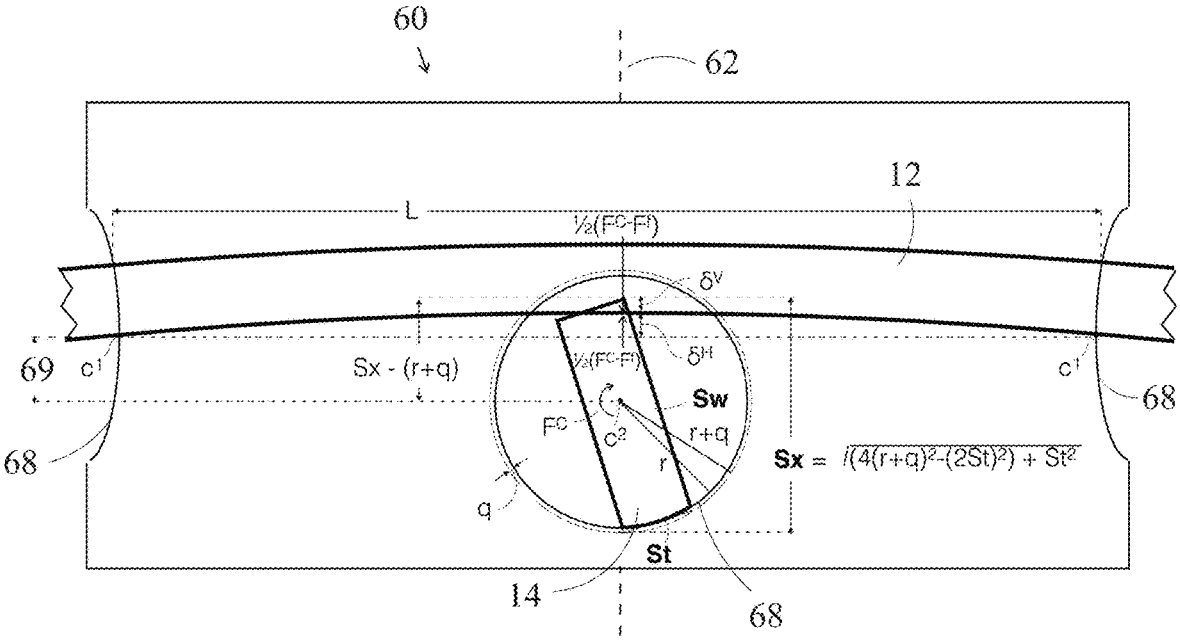

FIG. 15 is an enlarged elevational view of the ring and strips of FIG. 14, showing a detail of two strips of FIG. 1A-1C crossing inside the ring and exerting force on one another causing a deflection of both strips.

Intermediate Offset Holes

Figure 16:
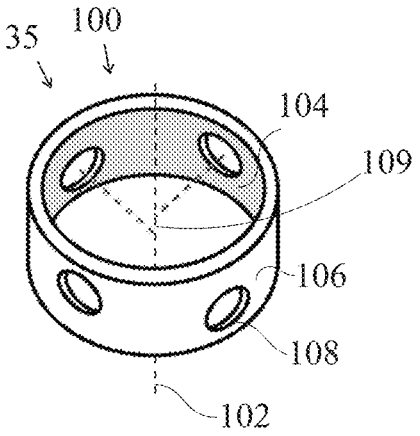

FIG. 16 is a perspective view of a ring with intermediate offset holes that have an offset distance that is a minimum distance necessary for a user applying force with easy effort to pass the strip of FIG. 1A and FIG. 1B through different holes and crossing inside the ring, with both strips rotated such that the narrow side of one strip interfaces with the narrow side of the other, holding both in friction, and showing a central axis of the ring and lines representing the shortest distance from the center of each hole to the central axis.

Figure 17:
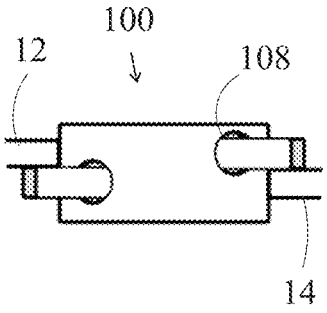

FIG. 17 is an elevation view of the ring with intermediate offset of FIG. 16, showing the strip of FIG. 1A and FIG. 1B passing through different holes and crossing inside the ring, with both strips rotated such that the narrow side of one strip interfaces with the narrow side of the other, holding both in friction.

Figure 18:
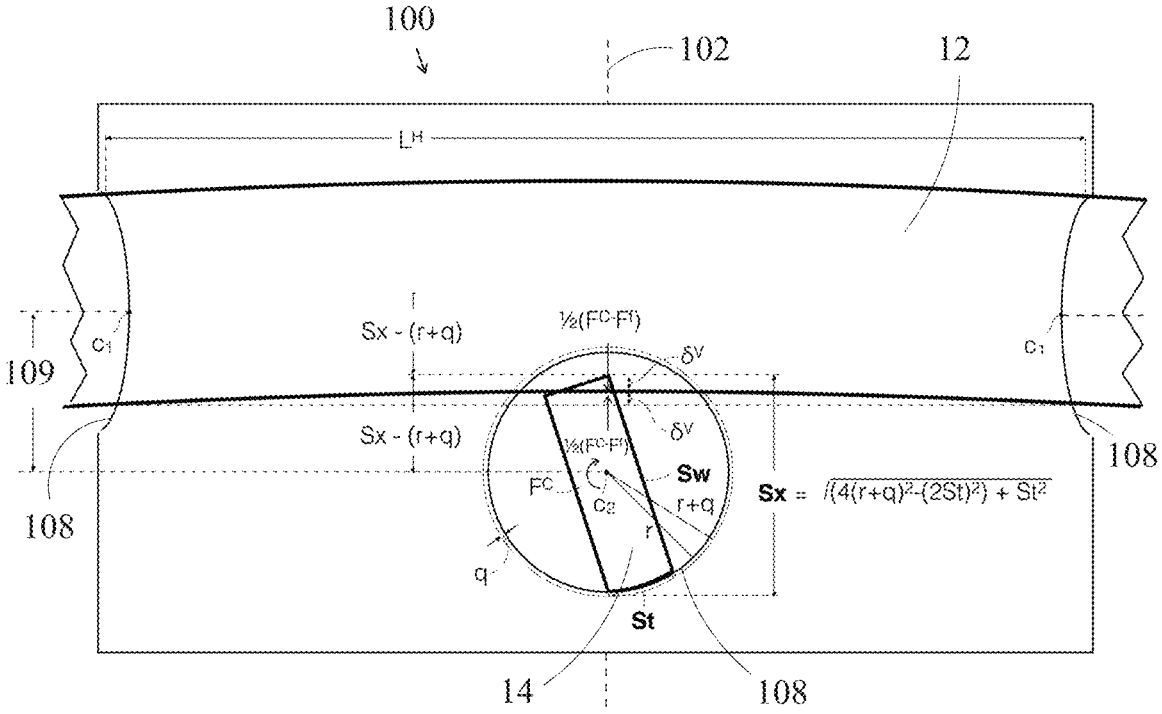

FIG. 18 is an enlarged elevational view of the ring and strips of FIG. 17, showing a detail of two strips of FIG. 1A-1C crossing inside the ring and exerting force on one another causing a deflection of both strips.

Rings with High Offset Holes

Figure 19:
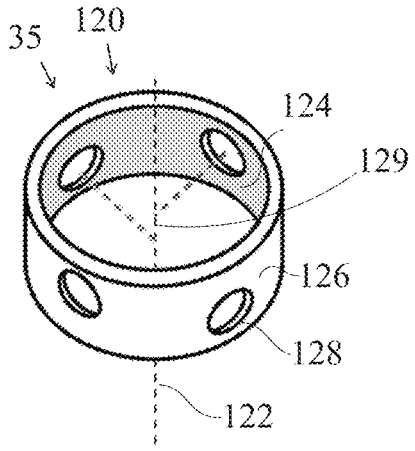

FIG. 19 is a perspective view of a ring with high offset holes that have an offset distance that is at least a minimum distance necessary for the strip of FIG. 1A and FIG. 1B to pass through different holes and be able to freely rotate without colliding inside the ring, and showing a central axis of the ring and lines representing the shortest distance from the center of each hole to the central axis.

Figure 20:
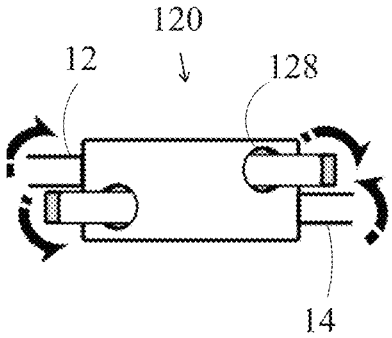

FIG. 20 is an elevational view of the ring with high offset holes of FIG. 19, showing two strips of FIGS. 1A and 1B passing through different holes and crossing inside the ring with arrows indicating that both strips are rotatable.

Figure 21:
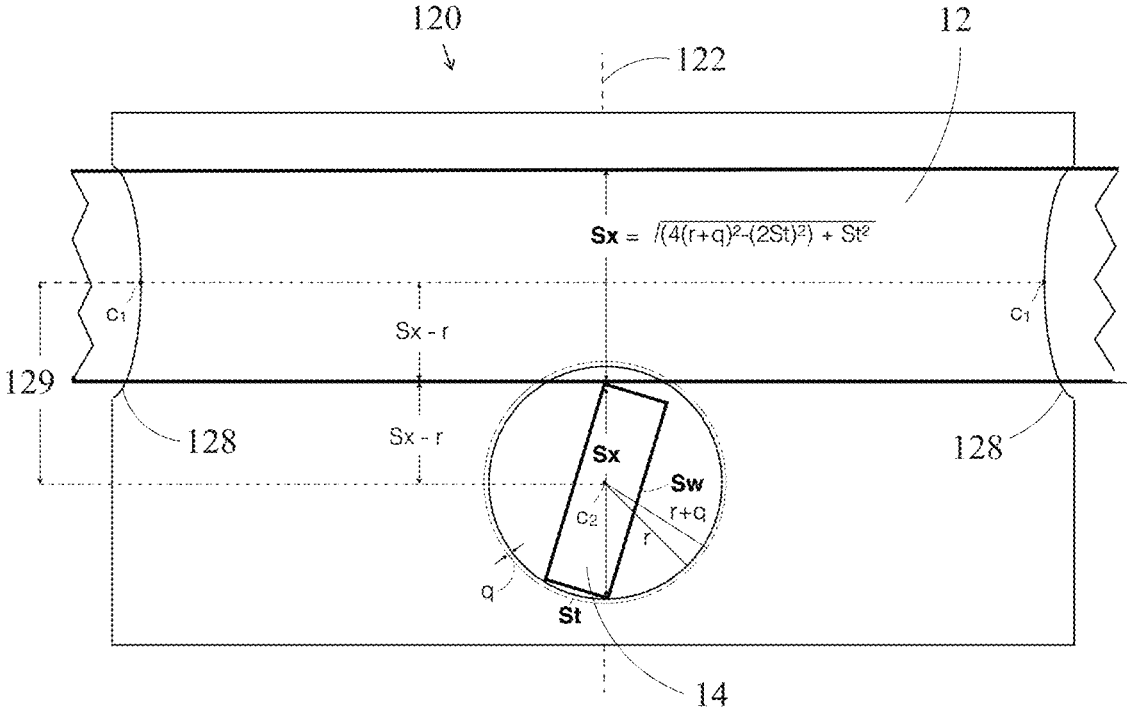

FIG. 21 is an enlarged elevational view of the ring and strips of FIG. 20, showing a detail of two strips of FIGS. 1A-1C crossing inside the ring, both strips rotatable without colliding.

Figure 22:
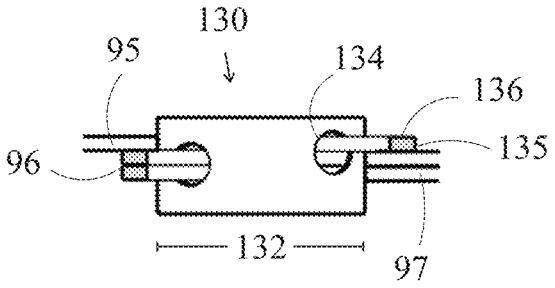

FIG. 22 is an elevation view of a ring with diameter of approximately 4 cm, holes with a radius of approximately 2.6 mm, and with low-offset holes, showing two stacked strips of FIG. 1C with thickness of approximately 2 mm passing through the lower holes and a third strip of FIG. 1A and FIG. 1B with thickness of approximately 2 mm passing through upper holes interfacing with the other strips inside the ring and all held in friction.

Figure 23:
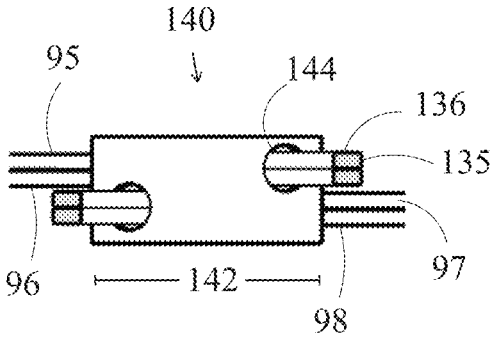

FIG. 23 is an elevational view of a ring with a diameter of approximately 4 cm, holes with a radius of approximately 2.6 mm, and with intermediate offset holes, showing a first pair of the stacked strips of FIG. 1C with thickness of approximately 2 mm and a second pair of the stacked strips of FIG. 1C with thickness of approximately 2 mm passing through different holes and crossing inside the ring, wherein the stacked strips are held in the holes by friction.

Compound Joints

Figure 24:
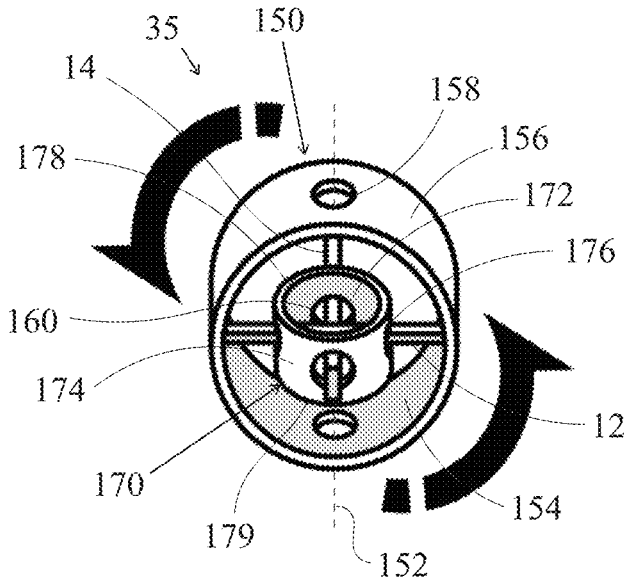

FIG. 24 is a perspective view of a smaller ring inside a larger ring, oriented with perpendicular central axes, wherein two strips of FIGS. 1A and 1B intersect at the center of both rings such that one strip extends along a central axis of the larger ring and wherein the smaller ring is a ring with low offset holes whereby the two strips may be locked in this position inside ring, creating a frictional axle and wheel system.

Figure 25:
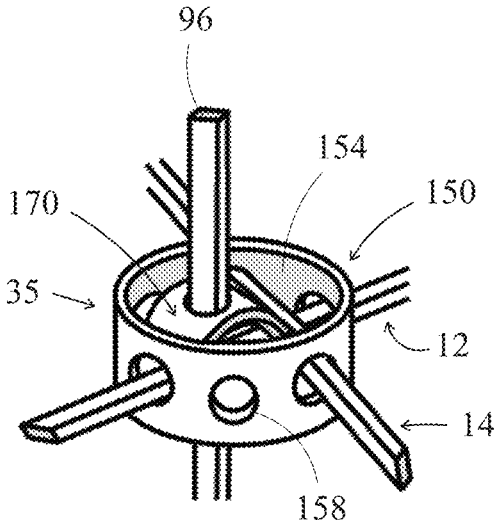

FIG. 25 is a perspective view of a configuration of nested rings, showing right angled joints.

Figure 26:
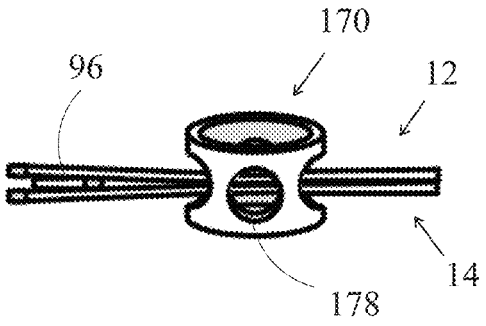

FIG. 26 is a perspective view of a right angled joint created by passing two strips of FIG. 1A and FIG. 1B in parallel through holes of a ring and wedging a third strip of FIG. 1A and FIG. 1B between the parallel strips on the exterior of the ring for forcing a "wedge" type joint that may also be used to tightly anchor the two parallel strips.

Pipes

Figure 27A:
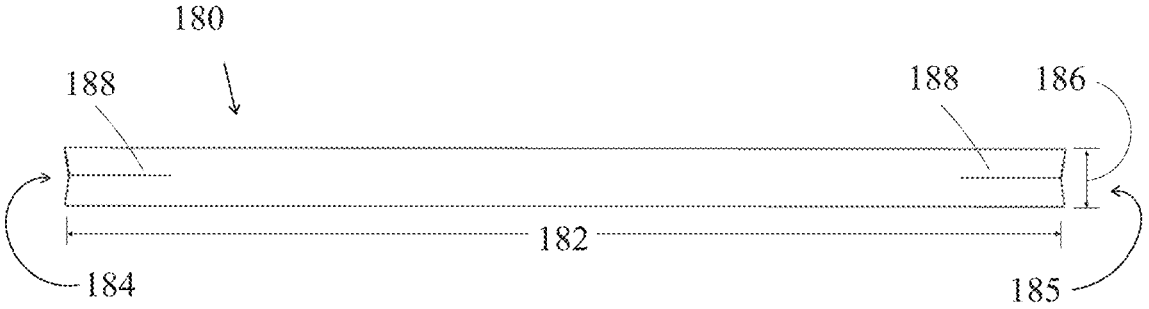

FIG. 27A is a top plan view of a pipe.

Figure 27B:
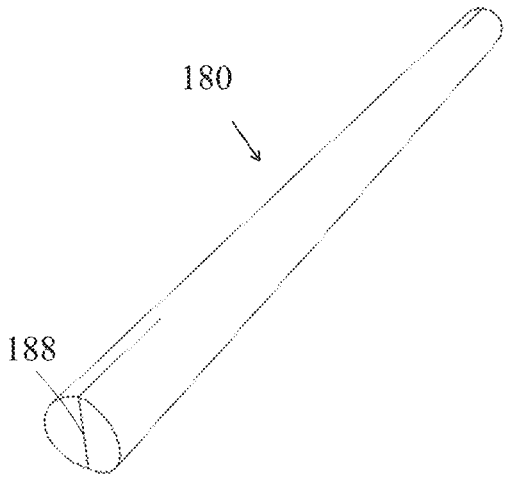

FIG. 27B is a top perspective view of a pipe.

Slips

Figure 28:
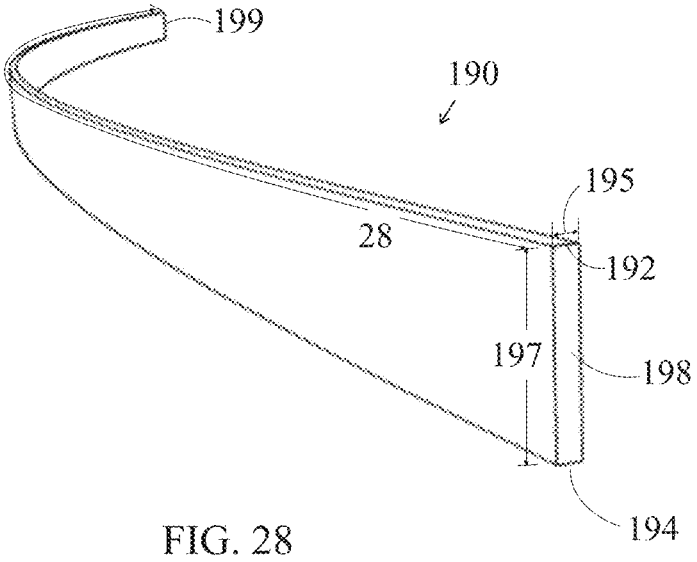

FIG. 28 is a top perspective view of a slip.

Caps

Figure 29A:
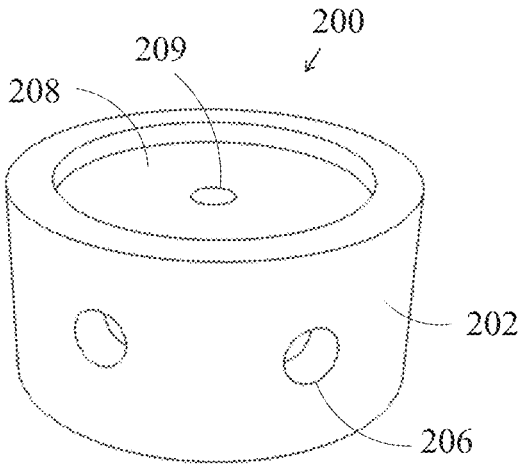

FIG. 29A is a top perspective view of a cap showing interior wall and orifice.

Figure 29B:
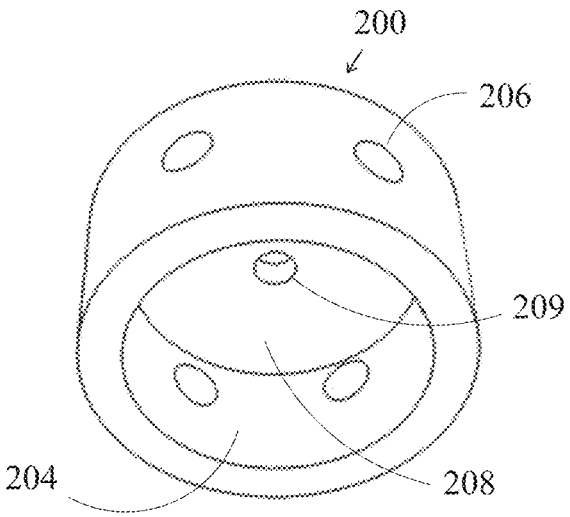

FIG. 29B is a bottom perspective view of a cap showing interior wall and orifice.

Stacked Rings

Figure 30:
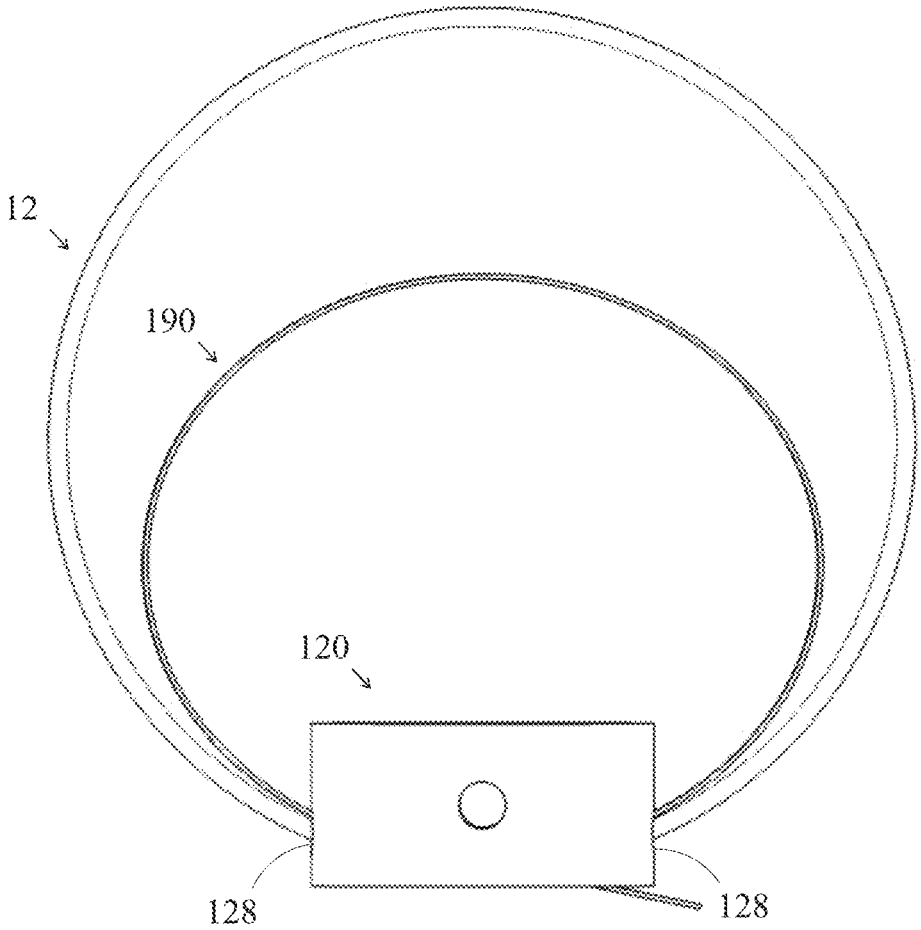

FIG. 30 is a side elevation view of a ring of FIG. 20, showing the strip of FIGS. 1A and 1B and the slip of FIG. 28 with one end of each inserted into a hole on the ring and curving in an arc with the opposite ends inserted into a hole on the opposite side of the ring, showing the smaller radius achievable with the slip.

Figure 31A:
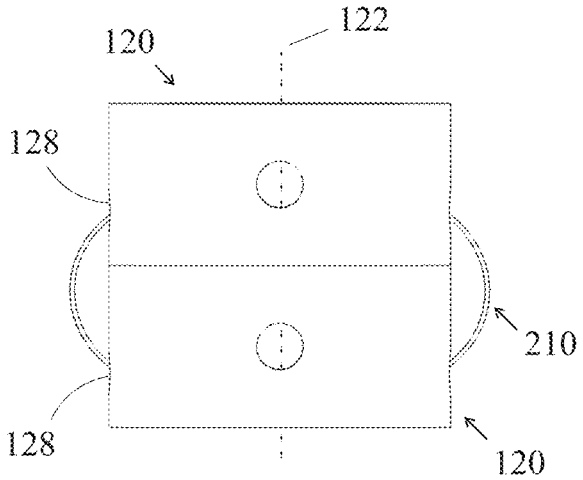

FIG. 31A is a side elevation view of two rings of FIG. 20, showing segments of the slip of FIG. 28 inserted into side holes of the rings such that the rings are attached and snug against one another along a common central axis.

Figure 31B:
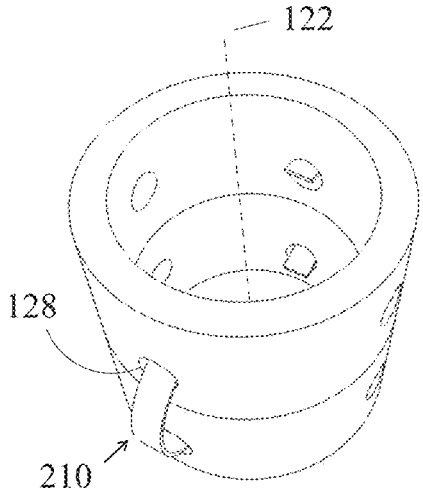

FIG. 31B is a top perspective view of the two rings of FIG. 31A.

Cap Assemblies

Figure 32:
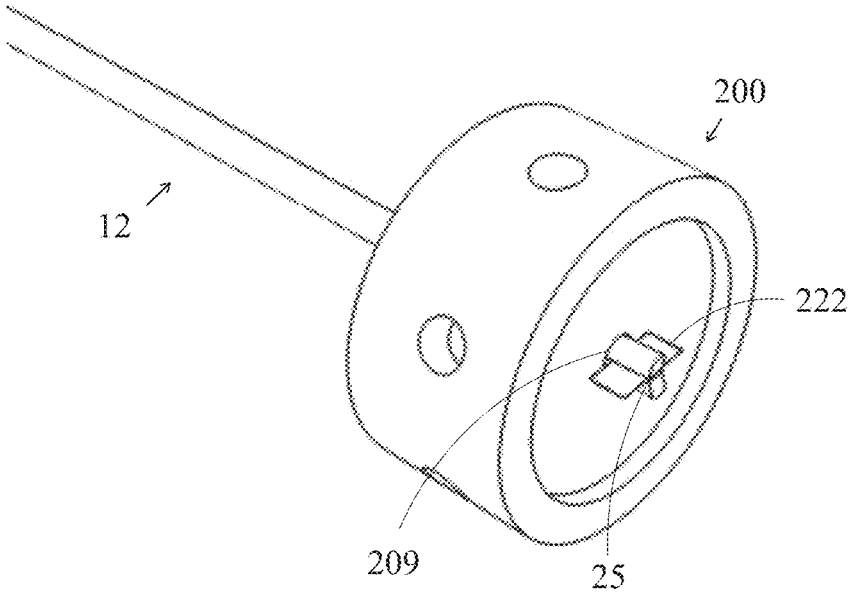

FIG. 32 is a perspective view of the cap of FIGS. 29A and 29B showing the strip of FIGS. 1A and 1B inserted into its orifice, with a slip segment of FIG. 28 anchored tightly in the fork at the end of the strip and holding the strip secure in a functional axle and wheel system.

Base Components

Figure 33A:
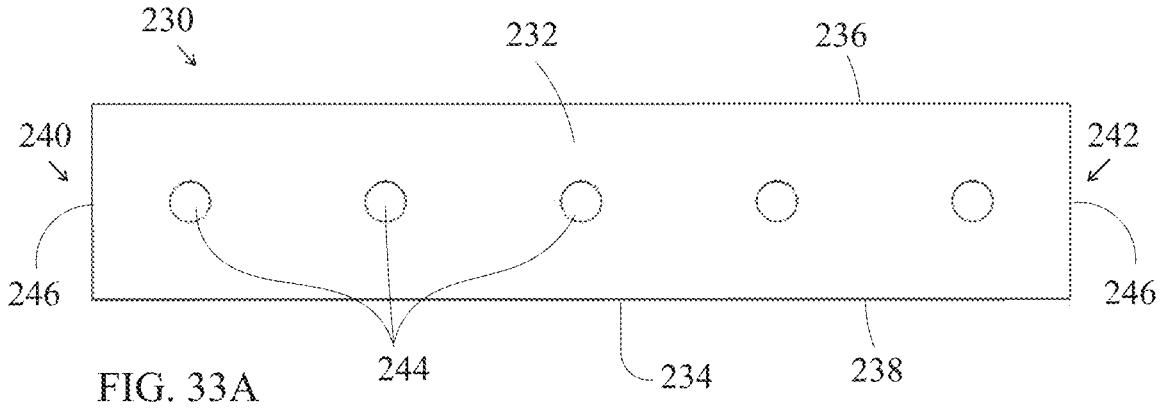

FIG. 33A is a bottom plan view of a base component defining a plurality of orifices.

Figure 33B:
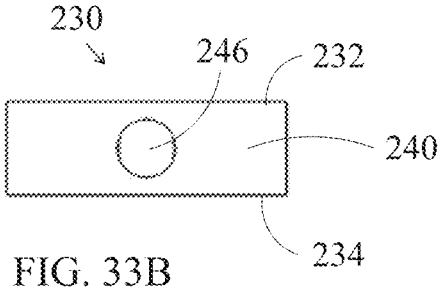

FIG. 33B is an end elevation view of the base component of FIG. 33A.

Figure 33C:
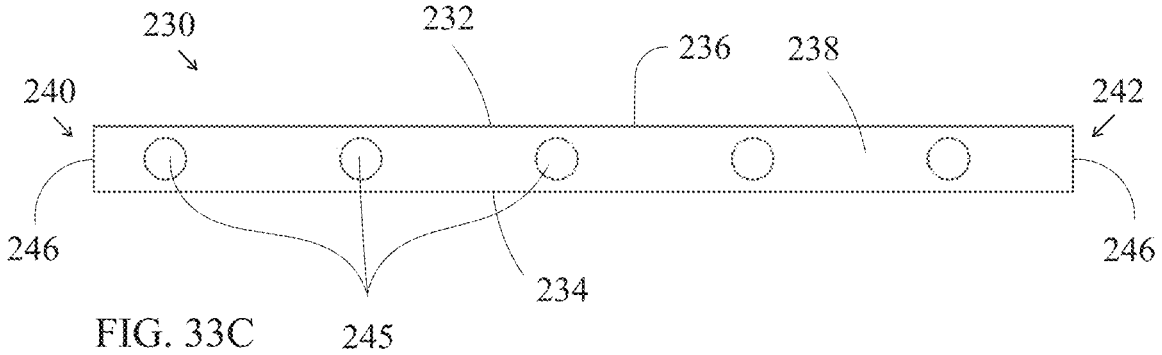

FIG. 33C is a side elevation view of a base component of FIG. 33A.

Figure 34A:
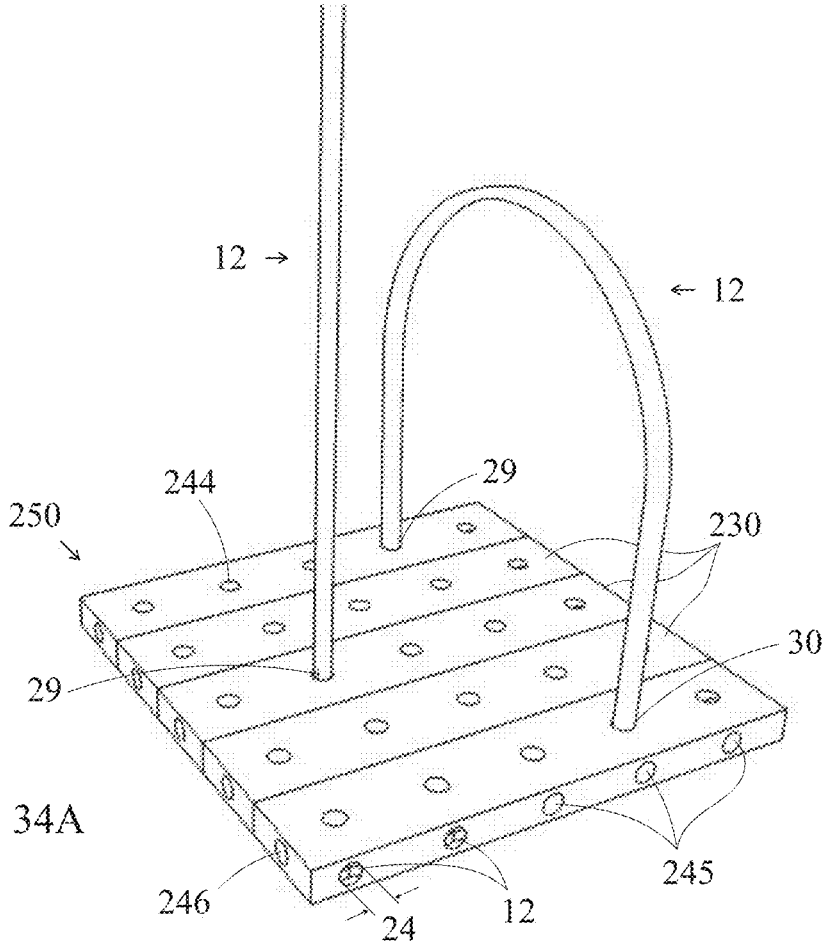

FIG. 34A is a perspective view of several of base components of FIGS. 33A-33C joined together with strips of FIGS. 1A and 1B in straight formation and receiving additional strips in orifices of the base components.

Figure 34B:
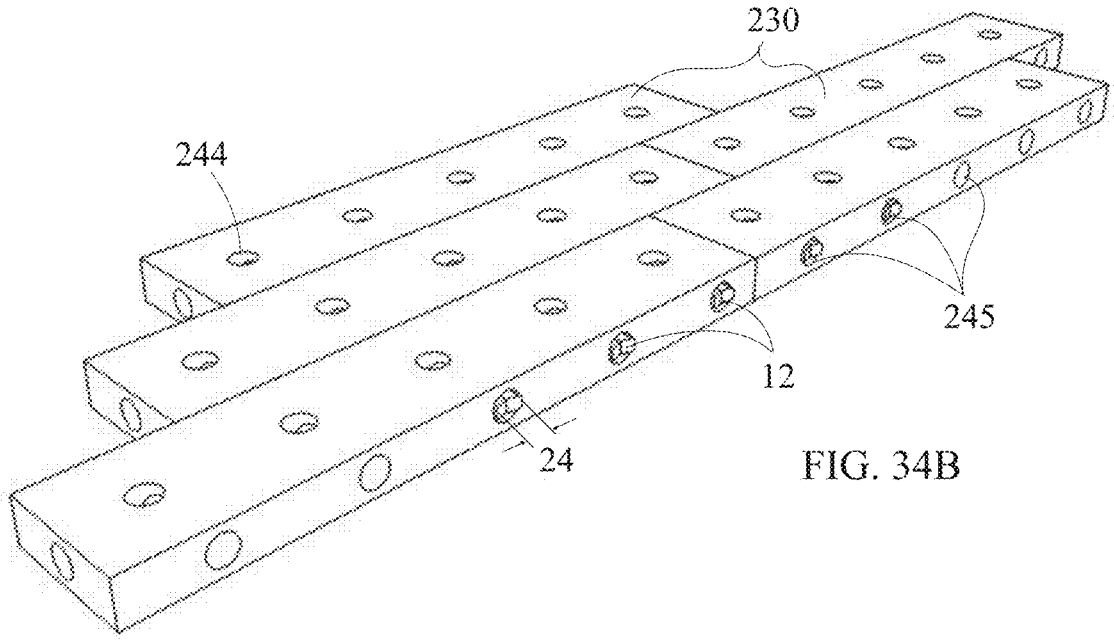

FIG. 34B is a perspective view of several base components of FIGS. 33A-33C joined together with strips of FIGS. 1A and 1B in a staggered formation.

Figure 35A:
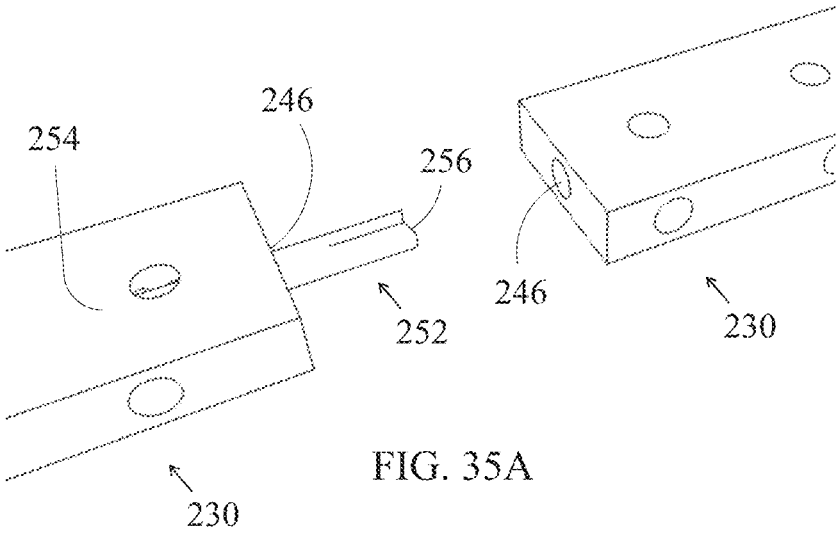

FIG. 35A is an enlarged perspective view of two base components of FIGS. 33A-33C having a strip segment inserted and frictionally secured in the end hole of one base component for forming a tenon.

Figure 35B:
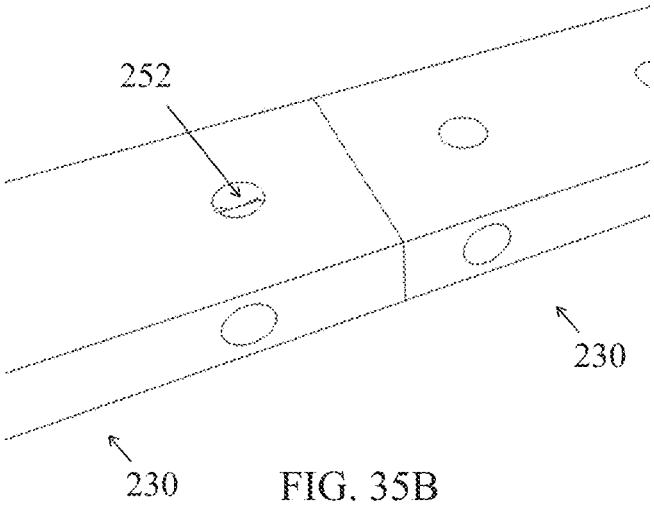

FIG. 35B is a perspective view of the base components of FIG. 35A shown joined together for forming a mortise and tenon type joint.

Figure 36A:
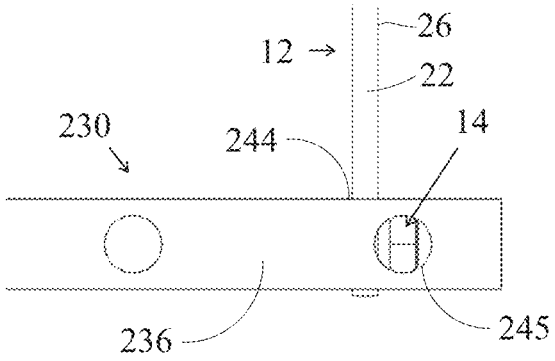

FIG. 36A is an enlarged side elevation view of a base component of FIGS. 33A-33C with strips 1A and 1B fitted in top and side holes.

Figure 36B:
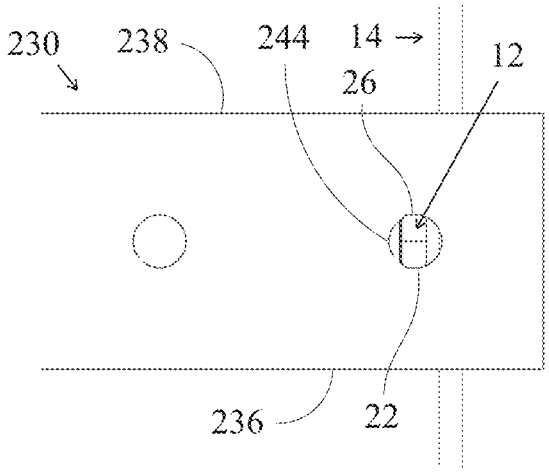

FIG. 36B is an enlarged top plan view of a base component of FIGS. 33A-33C with strips of FIGS. 1A and 1B fitted in top and side holes of the base component.

Figure 36C:
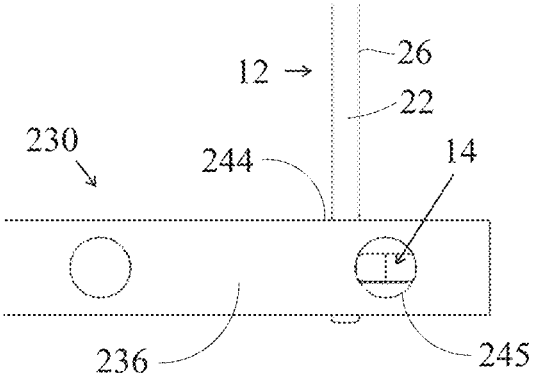

FIG. 36C is the same view as FIG. 36A showing the strip fitted in the side hole of the base component rotated to horizontal position such that it engages positively with the strip fitted into the top hole, both strips held frictionally in place.

Figure 36D:
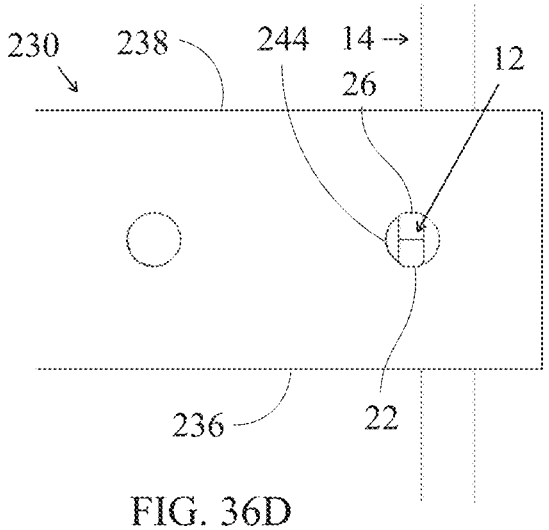

FIG. 36D is the same view as FIG. 36B showing the strip fitted in the side hole of the base component rotated to horizontal position such that it engages positively with the strip fitted into the top hole, both strips held frictionally in place.

Collar

Figure 37A:
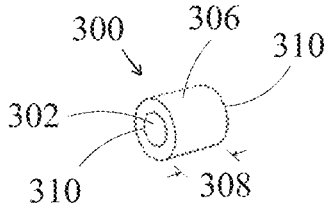

FIG. 37A is a perspective view of a collar component of shorter length.

Figure 37B:
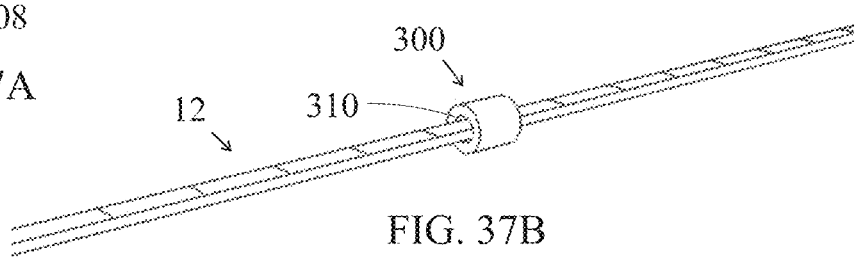

FIG. 37B is a perspective view of a color component of FIG. 37A showing the strip of FIGS. 1A and 1B passing through orifices at each end of the color component. And held frictionally secure.

Figure 38A:
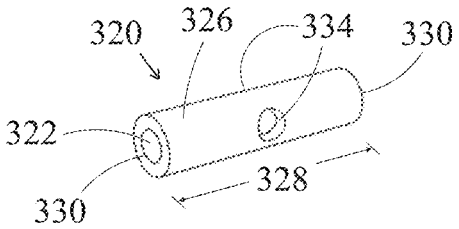

FIG. 38A is a perspective view of a collar component of longer length showing orifices at each end and orifices on the perimeter surface.

Figure 38B:
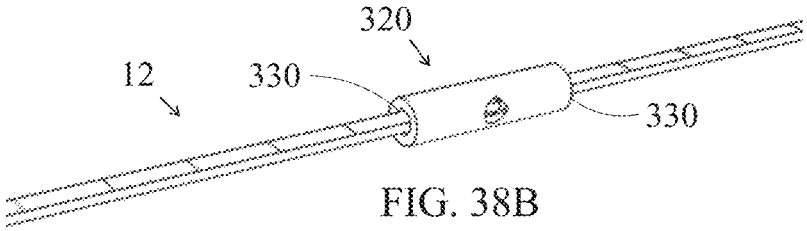

FIG. 38B is a perspective view of the collar component of FIG. 38A showing the strip of FIGS. 1A and 1B passing through the orifices at each end of the collar component.

Figure 38C:
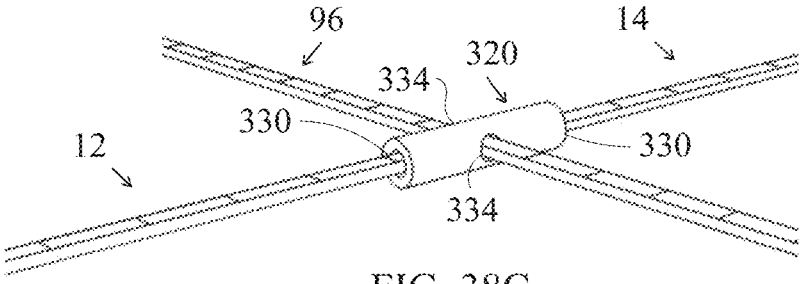

FIG. 38C is a perspective view of the collar component of FIG. 38A showing a strip of FIGS. 1A and 1B passing through an end orifice of the collar component and held frictionally secure, a second strip of FIGS. 1A and 1B passing through the opposite end orifice of the collar component and held frictionally secure, and a third strip of FIGS. 1A and 1B passing through a pair of perimeter orifices on the collar component and held frictionally secure.

Figure 39:
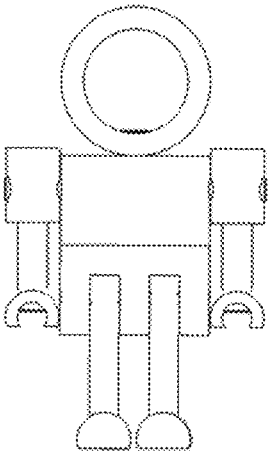

FIG. 39 is a front view of the toy figurine.

Figure 40:
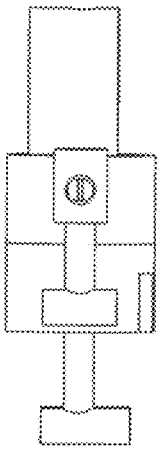

FIG. 40 is a side view of the toy figurine.

Figure 41:
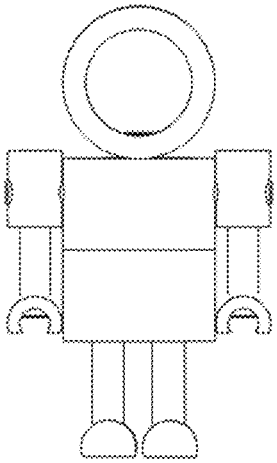

FIG. 41 is a rear view of the toy figurine.

Figure 42:
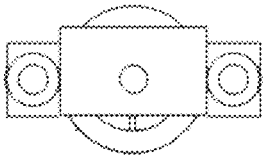

FIG. 42 is a top view of the toy figurine.

Figure 43:
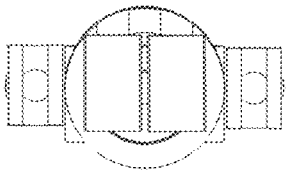

FIG. 43 is a bottom view of the toy figurine.

Figure 44:
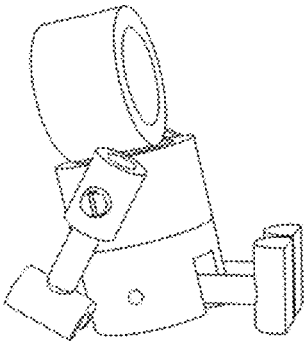

FIG. 44 is a perspective view of a toy figurine in another position.

Figure 45:
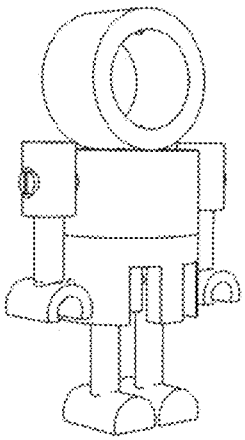

FIG. 45 is a perspective view of a toy figurine in another position.

Figure 46:
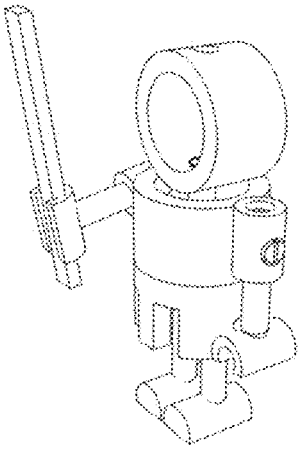

FIG. 46 is a perspective view of a toy figurine in another position with a strip segment inserted and frictionally secure.

Figure 47:
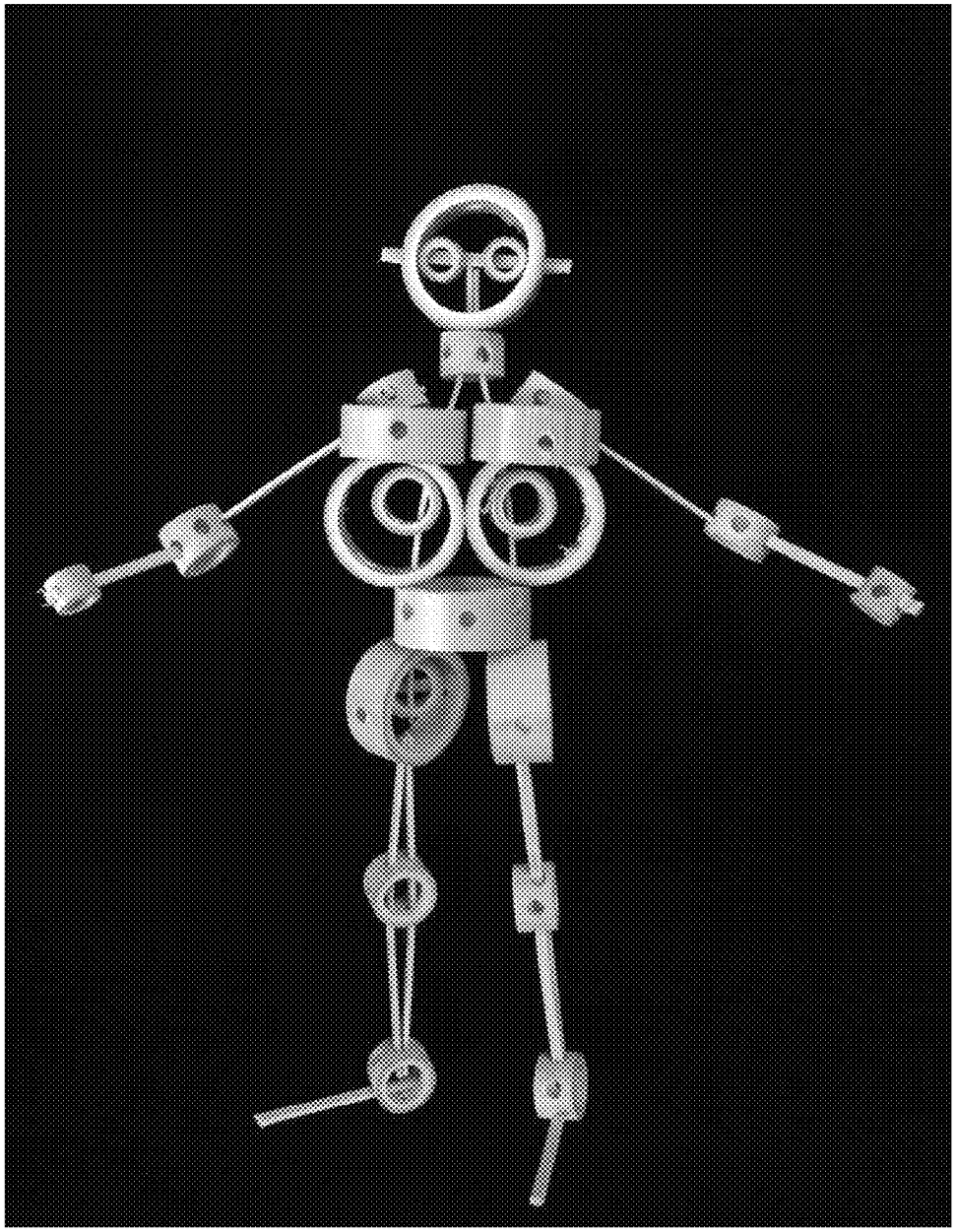

FIG. 47 is an example assembly in the form of a person.

Figure 48:
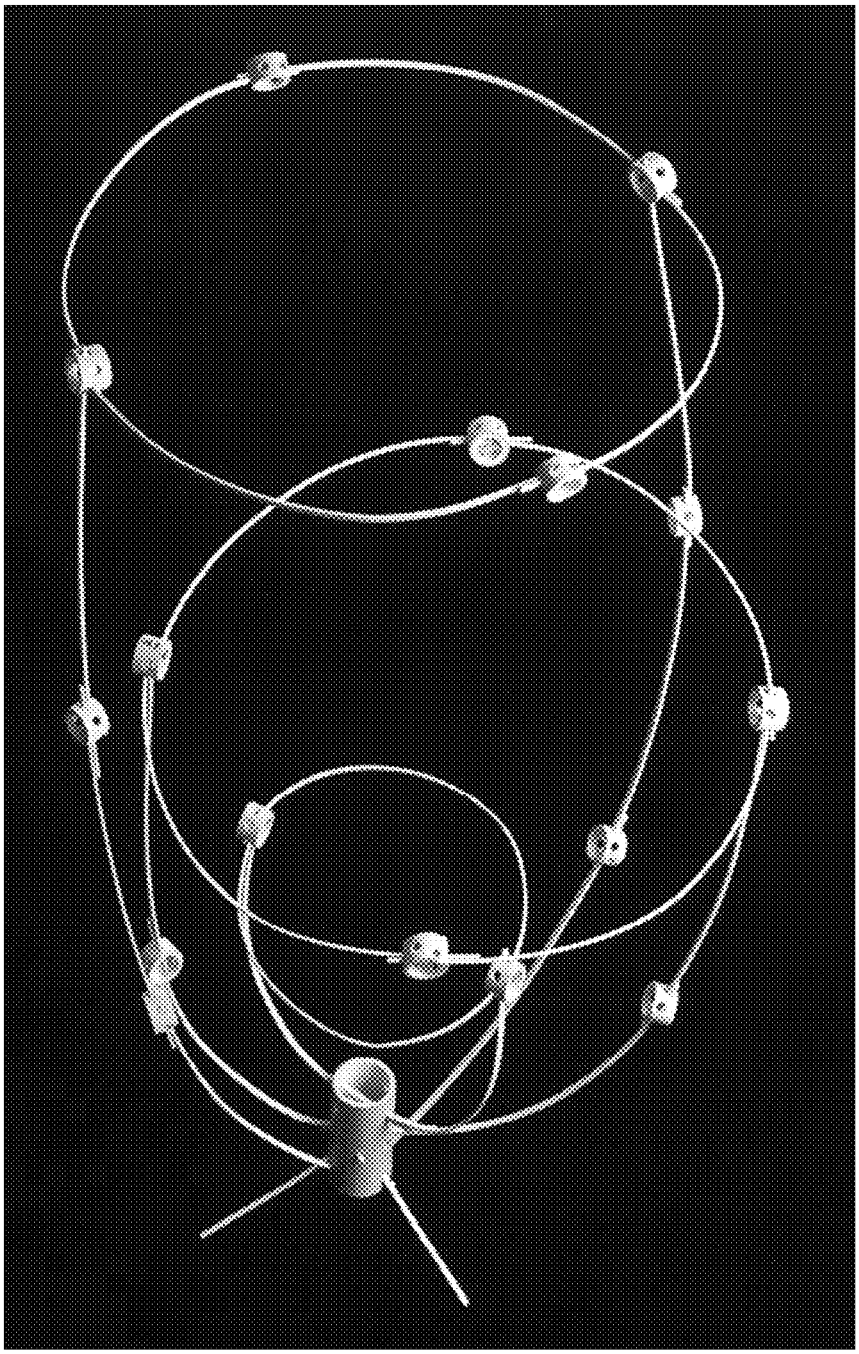

FIG. 48 is an example assembly in the form of a decoration.

Figure 49:
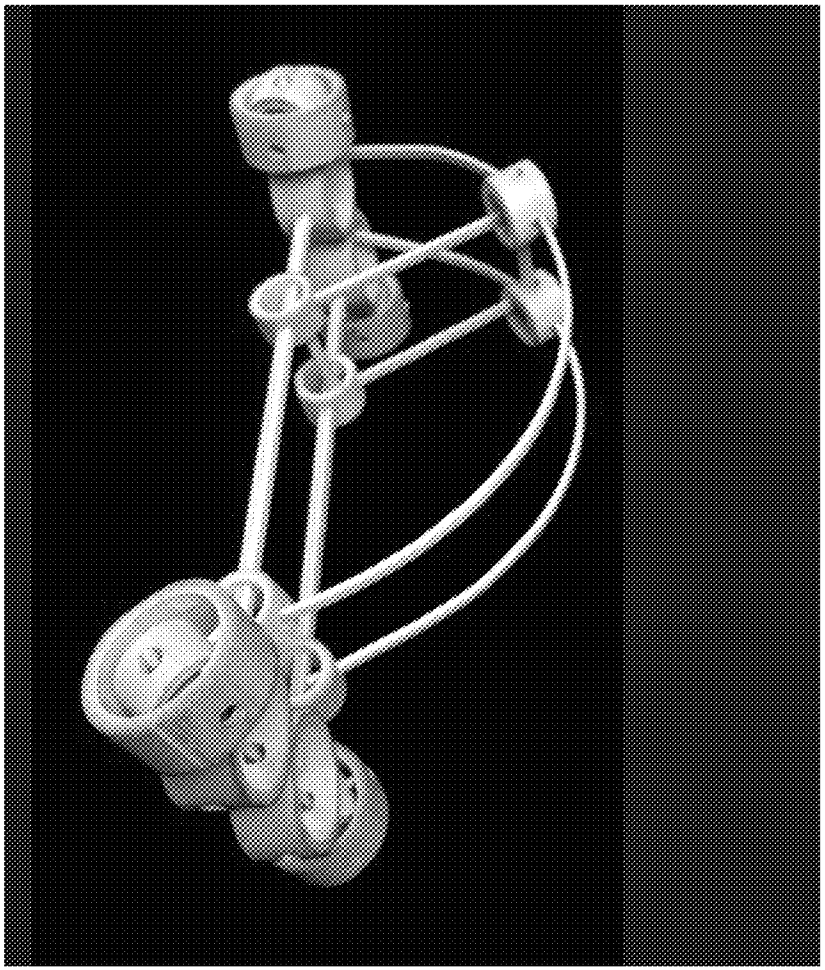

FIG. 49 is an example assembly in the form of a vehicle.

Figure 50:
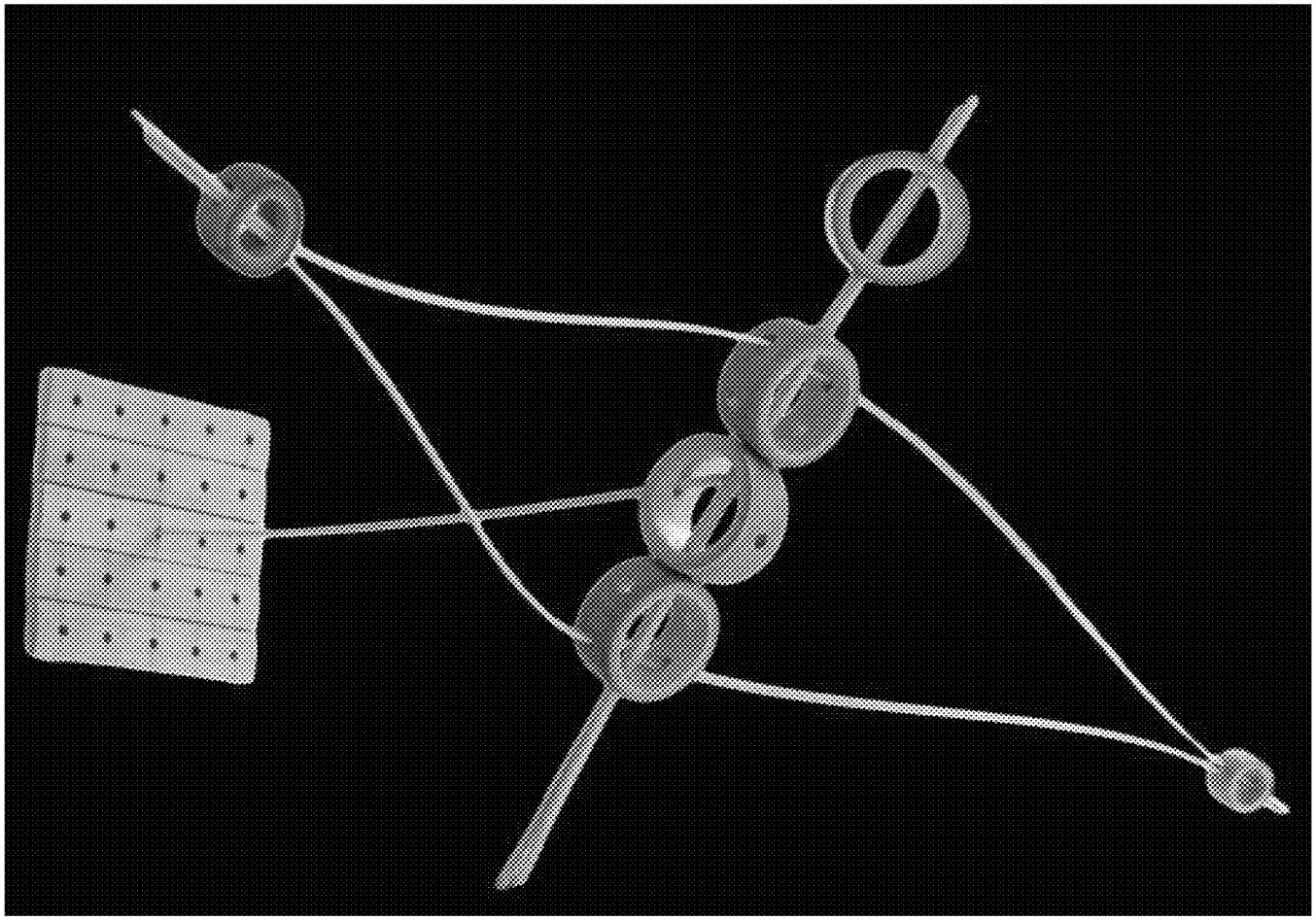

FIG. 50 is an example assembly in the form of a bird.

DETAILED DESCRIPTION OF THE PREFERRED EMBODIMENTS

The construction toy of the invention includes numerous components that may be assembled in various ways to achieve desired combinations, as discussed below. The construction toy of the invention is designated generally 10. Example assemblies constructed of the components of construction toy 10 may be seen in FIGS. 33-48.

Referring now to FIGS. 1A through 1C, construction toy 10 includes a plurality of strips, including first strip 12 and second strip 14. Each of strips 12 and 14 have a top surface 16 having width 18, and a bottom surface 20 having width 18. First edge 22 has thickness 24. Second edge 26 also has thickness 24. First strip 12 and second strip 14 have a length 28, four longitudinal edges 23 a first end 29 and a second end 30. In one embodiment, first end 29 and second end 30 are forked and an incision 25 bisecting each end extends from the vertex of the fork a distance, e.g., 1% to 5% or 4% to 2% or approximately 3%, down the length of the strip. Top surface 16 preferably defines a plurality of scores 31. Scores 31 may have dimensions equal to width 18 of strips 12, 14, and a depth sufficient to establish a break point in the material given a force easily exerted by a user. In one embodiment, scores 31 have a depth of approximately 1% to approximately 10% of thickness of strips 12, 14. In another embodiment, scores 31 have a depth of approximately 3% to 8% of thickness of strips 12, 14; in another embodiment, 5%.

Figure 2:
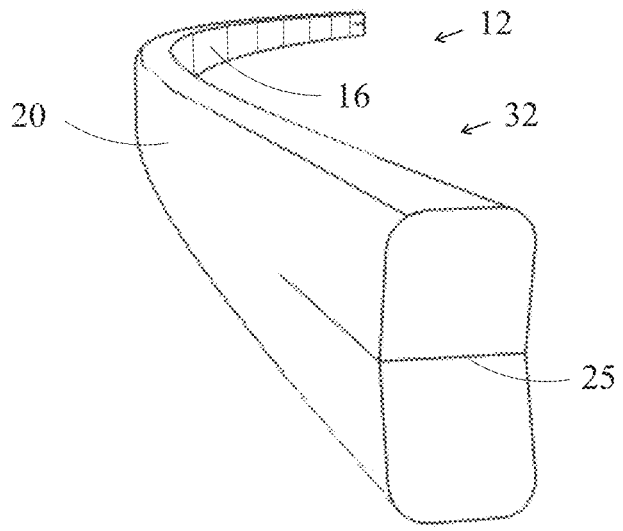
FIG. 2 is a perspective view of a strip of FIGS. 1A and 1B that has been worked into a curve with score marks on the inside of the curve, retaining its shape without tension.
Figure 3:
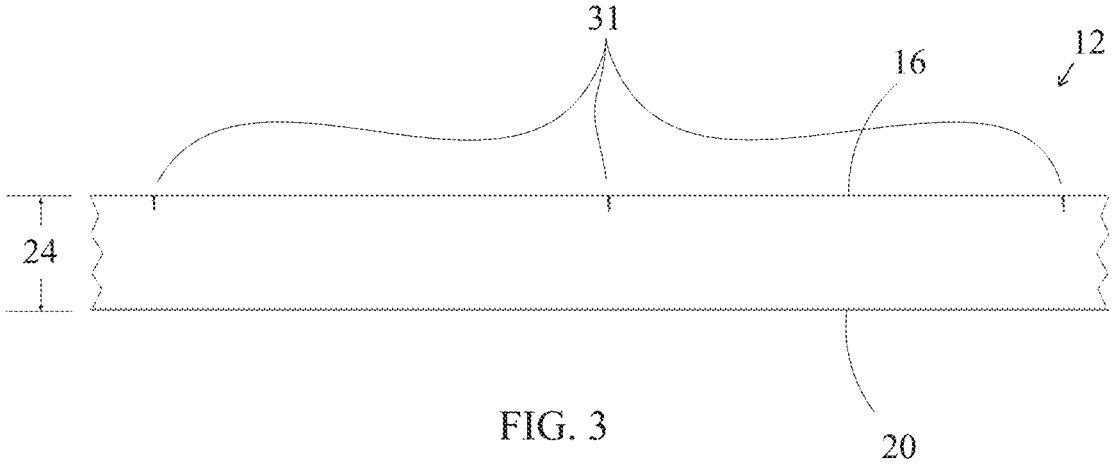
FIG. 3 is an elevation view of the strip of FIGS. 1A and 1B with detail of scores, showing incisions that cut across the top surface.
Figure 4:
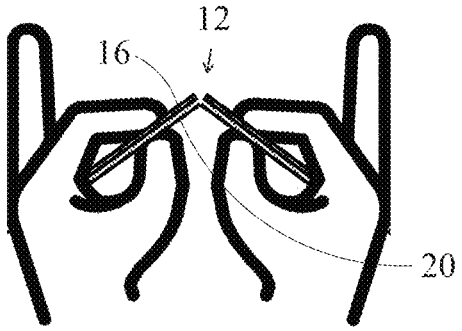
FIG. 4 is an image of the strip of FIGS. 1A and 1B held in two hands being broken at a score.
Figure 5:
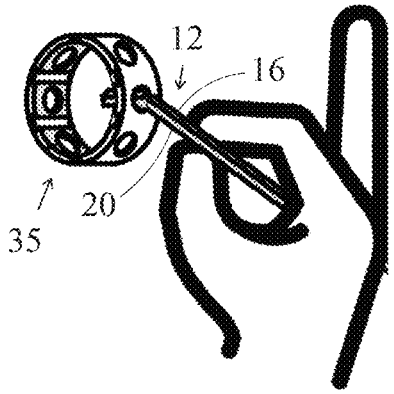
FIG. 5 is an image of the strip of FIGS. 1A and 1B held in one hand, being broken at a score by using a ring as lever.
Figure 6:
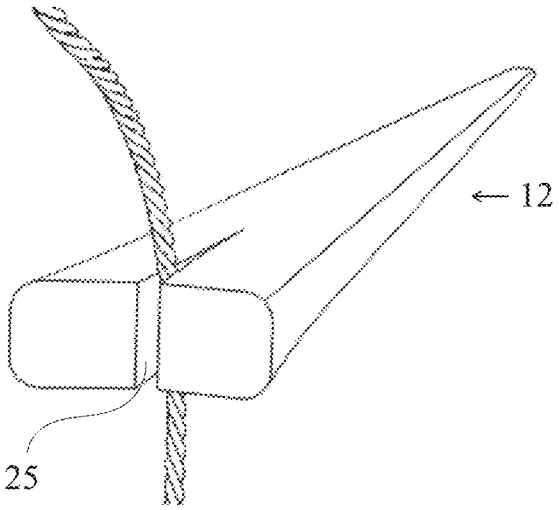
FIG. 6 is an enlarged perspective view of the strip of FIGS. 1A and 1B showing a string anchored tightly in the fork at the end of the strip.

Strip 12 (or 14) is preferably bendable into a curved orientation designated generally 32 (FIG. 2). Strips 12, 14 are preferably breakable at a selected one of scores 31 (see FIGS. 4, 5). Strips 12, 14 may preferably receive a string or other object in incision 25 bisecting each end of the strip (see FIG. 6). In one embodiment, strips 12, 14 are constructed of bamboo, although other materials may also be used.

Construction toy 10 includes a plurality of rings 35. Rings 35 (FIGS. 7-9) may be of several types, including the types discussed below. For purposes of this application, rings designated as 35 are intended to refer generally to the rings of construction toy 10. Rings 35 define a thickness 34, longitudinal axis 42, 62, 102, 122, inside surface 44, 64, 104, 124, and outside surface 46, 44, 106, 126. Rings 35 defines at least two perimeter orifices 48, 68, 108, 128, 134, 158. In a preferred embodiment, ring 35 defines four perimeter orifices 48, 68, 108, 128, 134, 158, although more are possible. In one embodiment, the radius r of orifices 48, 68, 108, 128, 134, 158 is proportionate to the thickness 24 and width 18 of the strips according to the equation:

$$r=\sqrt{((Sw^2+(2St)^2)/4)}-q$$

where Sw is defined as the width of the strips, St is defined as the thickness of the strips and is bounded by zero and Sw ($0<St<Sw$), and q is defined as the compression (elastic deformation) of the longitudinal edges 23 of the strips when the strips are stacked together inside a pair of orifices. The distance q may be derived from the equation for Young's modulus:

$$q=F^p L_0/AE$$

where $F^p$ is one-eighth of the force that a user may easily exert on a pair of stacked strips (estimated at approximately 10 newtons for strips with width 18 less than 2 centimeters) to position them inside a pair of orifices (e.g. making eight points of contact, four per orifice); $L_0$ is defined as the length of the hypotenuse of the triangle whose legs are equal to half the width 18 of a strip and the thickness 24 of a strip ($L_0=\sqrt{(\frac{1}{2}Sw^2+St^2)}$; A is defined as the cross-sectional area of the longitudinal edge 23 of a strip where it is in contact along the thickness 34 of an orifice 48, 68, 108, 128, 134, 158, and E is defined as the elastic modulus (Young's modulus) of the material of the strips in the direction of radius r.

A trial and error approach to determining an effective radius for perimeter orifices 48, 68, 108, 128, 134, 158 may be practical. Approximations of the relationship between the strip dimensions and radius of the perimeter orifices 48, 68, 108, 128, 134, 158 on the rings 35 described by the above equation will work, with deviations from the described relationship of $+/-\sqrt{(2q^2)}$ effective, $+/-\frac{1}{2}\sqrt{(2q^2)}$ more effective and the described relationship $+/-\frac{1}{4}\sqrt{(2q^2)}$ most effective (FIG. 9).

One type of ring 35 is no offset ring 40. No offset ring 40 (FIGS. 7-11) defines longitudinal axis 42, inside surface 44, and outside surface 46. Ring 40 defines at least two perimeter orifices 48. In a preferred embodiment, ring 40 defines four perimeter orifices 48, although other numbers of orifices are possible. Perimeter orifices 48 are sized to receive first strip 12 and second strip 14 stacked together and held within a perimeter orifice 48 by friction (FIGS. 8, 9). At least two pairs of perimeter orifices 48 of no-offset ring 40 are centered on a radial plane of ring 40. Perimeter orifices 48 preferably make up first pair of orifices and second pair of orifices. First strip 12 may be positioned to pass through each of a first pair of orifices 48. Second strip 14 may be positioned to pass through each of a second pair of orifices 48 wherein first strip 12 and second strip 14 engage one another at a center of no-offset ring 40 (FIGS. 10, 11). The engagement of first strip 12 and second strip 14 serves to hold each piece in place by friction. For purposes of this application, "horizontally" is defined as the orientation wherein upper surface 16 or lower surface 20 of strips 12 and 14 is oriented normally to longitudinal axis 36 of rings 35. "Vertically" is defined as the orientation wherein upper surface 16 or lower surface 20 of strips 12 and 14 is oriented parallel to the longitudinal axis 36 of rings 35.

Referring now to FIGS. 12-14, low offset ring 60 is shown. Low offset ring 60 defines longitudinal axis 62, inside surface 64, and outside surface 66. Low offset ring 60 has at least two perimeter orifices 68. In a preferred embodiment, low offset ring 60 has four perimeter orifices 68, although other numbers of orifices are possible. Perimeter orifices 68 may include a first higher pair of orifices 68 and second lower pair of orifices 68. The first higher pair of orifices are offset from the second pair of orifices by an offset distance 69 that is the minimum distance necessary for a user applying a force with easy effort (estimated at approximately 30 newtons for strips with width 18 less than approximately 2 centimeters) to rotate a second strip 14 positioned horizontally in the second pair of orifices to be positioned vertically while a first strip 12 is positioned horizontally in the first pair of orifices. A detailed description of the calculation of offset distance 69 is below.

Referring now to FIG. 13, first strip 12 may be positioned horizontally in the first pair of orifices 68 and second strip 14 may be positioned horizontally in the second pair of orifices 68. As indicated by the arrows of FIG. 11, first strip 12 and second strip 14 are slidable within orifices 68 in this configuration. Referring now to FIG. 14, first strip 12 may be located horizontally in the first pair of orifices 68, and second strip 14 may be located vertically in the second pair of orifices 68. In this configuration, first strip 12 and second strip 14 will make contact inside of low offset ring 60 and be held in place by friction. The offset distance 69 is calculated according to the equation:

$$O=\sqrt{((4((r+q)^2)-(2St)^2)+St^2)}-(r+q)-(\delta^H+\delta^V)$$

where O is the offset distance 69, r is the radius of orifices 68, q is defined as the compression of the corners of the strips along radius r, St is the thickness 24 of the strips and $\delta^H$ and $\delta^V$ are defined as the deflection of first strip 12 and second strip 14, respectively, from their rest position (FIG. 15). The deflection component $\delta^H+\delta^V$ is a function of the centripetal force $F^c$ that may be easily generated by a user on the second strip 14 in order to rotate it from horizontal to vertical position (estimated at approximately 30 Newtons for strips with width 18 less than approximately 2 centimeters); the friction force $F^f$ of first strip 12 and second strip 14 acting on one another as second strip 14 is rotated; the diameter L of ring 60 across which the first strip 12 and the second strip 14 spans; the elastic modulus (Young's modulus) E of the material of the strips; and the area moment of inertia of the first strip 12 when located horizontally and second strip 14 when located vertically. The deflection component $\delta^H+\delta^V$ is ideally calculated according to the equation:

$$\delta^H+\delta^V=(((F^C-F^f)/2)(L)^3)/(48E((Sw*St^3)/12))+(((F^C-F^f)/2)(L)^3)/(48E((St*Sw^3)/12))$$

Approximations of this equation for calculating the offset distance 69 will work, with deviations from the described calculation of +/−10% of the thickness 24 of the strips effective, +/−5% of the thickness 24 of the strips more effective, and +/−2% of the thickness 24 of the strips most effective.

Referring now to FIGS. 16-18, intermediate offset ring 100 is shown. Intermediate offset ring 100 defines longitudinal axis 102, inside surface 104, and outside surface 106. Intermediate offset ring 100 has at least two perimeter orifices 108. Intermediate offset ring 100 preferably has four perimeter orifices 108, although other numbers of orifices are possible. Perimeter orifices 108 may include a first pair of high orifices 108 and a second pair of lower orifices 108. The first pair of orifices 108 are offset from the second pair of orifices 108 by an offset distance 109 that is the minimum distance necessary for a user applying a force with easy effort (estimated at approximately 30 newtons for strips with width 18 less than approximately 2 centimeters) to rotate a second strip 14 positioned horizontally in the second pair of orifices to be positioned vertically while a first strip 12 is positioned vertically in the first pair of orifices. A detailed description of the calculation of offset distance 109 is below.

Referring now to FIG. 17, first strip 12 may be located vertically in the first pair of orifices 108 and second strip 14 may be located vertically in the second pair of orifices 108. In this configuration, strips 12 and 14 engage one another inside of intermediate offset ring 100 and are held in place by friction.

The offset distance 109 is calculated ideally according to the equation:

$$O=2\sqrt{((4((r+q)^2)-(2St)^2)+St^2)}-(r+q)-2\delta^V$$

where O is the offset distance 109, r is the radius of orifices 108, q is defined as the compression of the corners of the strips along radius r, St is the thickness 24 of the strips and $\delta^V$ is defined as the deflection of first strip 12 and second strip 14 from their rest position (FIG. 18). The deflection component $2\delta^V$ is a function of the centripetal force $F^c$ that may be easily generated by a user on the second strip 14 in order to rotate it from horizontal to vertical position (estimated at approximately 30 newtons for strips with width 18 less than approximately 2 centimeters); the friction force $F^f$ of first strip 12 and second strip 14 acting on one another as second strip 14 is rotated; the diameter L of ring 100 across which the first strip 12 and the second strip 14 spans; the elastic modulus (Young's modulus) E of the material of the strips; and the area moment of inertia of the first strip 12 when located horizontally and second strip 14 when located vertically. The deflection component $2\delta^V$ is calculated according to the equation:

$$2\delta^V=2(((F^C-F^f)/2)(L)^3)/(48E((St*Sw^3)/12))$$

Approximations of this equation for calculating the offset distance 109 will work, with deviations from the described calculation of +/−10% of the thickness 24 of the strips effective, +/−5% of the thickness 24 of the strips more effective, and +/−2% of the thickness 24 of the strips most effective.

Referring now to FIGS. 19-21, high offset ring 120 is shown. High offset ring 120 defines longitudinal axis 122, inside surface 124, and outside surface 126. High offset ring 120 has at least two perimeter orifices 128. High offset ring 120 preferably has four perimeter orifices 128, although other numbers of orifices are possible. Perimeter orifices 128 may include a first pair of higher orifices 128 and second pair of lower orifices 128. The first pair of orifices 128 are offset from the second pair of orifices 128 by an amount greater than or equal to the offset distance 129 that is the minimum distance necessary for a first strip 12 positioned in the first pair of orifices 128 and for a second strip 14 positioned in the second pair of orifices 128 to be able to rotate freely without colliding. A detailed description of the calculation of offset distance 129 is below.

Referring now to FIG. 20, first strip 12 may be located vertically in the first pair of orifices 128 and second strip 14 may be located vertically in second pair of orifices 128. In this configuration, strips 12 and 14 are rotatable within orifices 128, as indicated by the arrows of FIG. 20. The offset distance 129 is calculated according to the equation $$O=2(\sqrt{((4((r+q)^2)-(2St)^2)+St^2)}-r)$$

where O is the offset distance 129, r is the radius of orifices 128, q is defined as the compression of the corners of the strips along radius r, and St is the thickness 24 of the strips (FIG. 21). Approximations of this equation for calculating the offset distance 129 will work, with deviations from the described calculation of +/−10% of the thickness 24 of the strips effective, +/−5% of the thickness 24 of the strips more effective, and +/−2% of the thickness 24 of the strips most effective.

Referring now to FIGS. 22-23, two cases of configurations of strips 12 positioned in different pairs of orifices 134 with offset holes discussed above and crossing inside a ring 35 are shown. In these cases and others for the given offset, feasibility is contingent on the material and dimensions of the strips, the diameter of the ring, and the radius of the orifice. Conversely, for a given strip material and strip dimensions, ring diameter and orifice radius, an offset distance may be found for which these cases and others may be feasible.

Referring now to FIG. 22, ring 130 is shown, which is a type of low offset ring 60. Ring 130 defines a diameter 132 of approximately 4 centimeters and two pairs of perimeter orifices 134 with radius approximately 2.6 millimeters and an offset distance of approximately 1.0 millimeters. First strip 95, second strip 96, and third strip 97 defines a thickness 135 of approximately 2 millimeters and a width 136 of approximately 4 millimeters and are made of bamboo. First strip 95 may be received horizontally in the first pair of orifices 134 and second strip 96 and third strip 97 may be stacked and received horizontally in second pair of orifices 134. In this configuration, first strip 95 engages with second 97 and third 98 strips and all are held in friction.

Referring now to FIG. 23, ring 140 is shown, which is a type of intermediate offset ring 100. Ring 140 defines a diameter 142 of approximately 4 centimeters and two pairs of perimeter orifices 144 with radius approximately 2.6 millimeters and an offset distance of approximately 2.5 millimeters. First strip 95, second strip 96, third strip 97 and fourth strip 98 defines a thickness 135 of approximately 2 millimeters and a width 136 of approximately 4 millimeters and are made of bamboo. First strip 95 and second strip 96 may be stacked and received horizontally in the first pair of orifices 144 and third strip 97 and fourth strip 98 may be stacked and received horizontally in the second pair of orifices 144. In this configuration, first strip 95 and second strip 96 are held by frictional engagement with first pair of orifices 144 and stacked third strip 97 and fourth strip 98 are held in frictional engagement with the second pair of orifices 144.

Referring now to FIG. 24, large ring 150 is shown. Large ring 150 defines longitudinal axis 152, inside surface 154, and outside surface 156. Large ring 150 has at least two perimeter orifices 158 and preferably has four perimeter orifices 160, although other numbers of orifices are possible. Still referring to FIG. 24, small ring 170 is also shown. Small ring 170 defines a longitudinal axis, inside surface 174, outside surface 176, and at least two perimeter orifices 178. Small ring 170 preferably defines four perimeter orifices 178, although other numbers of orifices are possible. In the configuration of FIG. 24, first strip 12 passes through opposite orifice 158 of large ring 150 and passes through a center of large ring 150. Second strip 14 passes through opposite orifice 178 of small ring 170 and passes through a center of small ring 170 where first strip 12 and second strip 14 frictionally engage on another such that both are frictionally secured. As indicated by the arrows of FIG. 24, large ring 150 is rotatable with regard to small ring 170, thereby forming an axle and wheel assembly.

Referring now to FIG. 25, shown is large ring 150. First strip 12 may pass through opposite orifices 158 of large ring 150 to cross a center of large ring 150. Second strip 14 may pass through orifices 158 of large ring 150 to form a chord in large ring 150. Small ring 170 may be received inside large ring 150, wherein outer surface 176 of small ring 170 is wedged between second strip 14 and inside surface 154 of large ring 150. Third strip 96 may be received in opposite orifice 178 of small ring 170 and at right angles.

Referring now to FIG. 26, a first pair of orifices 178 of small ring 170 may receive a first strip 12 and a second strip 14 stacked together. Third strip 96 may be wedged between first strip 12 and second strip 14 for forming a wedge-type joint for tightly anchoring first strip 12 and second strip 14 within orifice 178 of small ring 170.

Referring now to FIGS. 27A and 27B, a pipe 180 is shown. Pipe 180 has a length 182. First end 184 has a diameter 186. Second end 185 also has a diameter 186. In one embodiment, first end 184 and second end 185 are forked and an incision 188 bisecting each end extends from the vertex of the fork approximately 3% down the length 182 of the pipe.

Referring now to FIG. 28, a slip 190 is shown. First edge 192 has thickness 195. Second edge 194 also has thickness 195. Slip 190 has a length 28, a width 197, a first end 198 and a second end 199.

Referring now to FIGS. 29A and 29B, a cap 200 is shown. Cap 200 defines outside surface 202 and inside surface 204. Cap 200 has at least two perimeter orifices 206. Cap 200 preferably has six perimeter orifices 206, although other numbers of orifices are possible. Perimeter orifices 206 may include a first pair of orifices 206, a second pair of orifices 206 and a third pair of orifices 206 each at various offsets. Cap 200 has an interior wall 208. Interior wall 208 has an orifice at its center 209 preferably sized to receive first end 29 or second end 30 of first strip 12.

Referring now to FIG. 30, a pair of orifices 128 on ring 120 receive first end 29 and second end 30 of strip 12 such that strip 12 is frictionally and tensionally secured in a curve. The same pair of orifices 128 on ring 120 also receive first end 198 and second end 199 of slip 190 such that the slip 190 is frictionally and tensionally secured in a curve. In the configuration of FIG. 30, first end 198 of slip 190 is advanced through the orifice 128 on ring 120 such that the slip 190 defines a curve with a smaller radius than is achievable with the strip 12.

Referring now to FIGS. 31A and 31B, two rings 120 are shown abutting along a common longitudinal axis 122. A pair of orifices 128 on each ring 120 receive segments 210 of slip 190. Slip segments 210 are held frictionally and tensionally secure in the orifices, and secure the two rings in their abutting configuration.

Referring now to FIG. 32, an orifice 209 in the interior wall 208 of cap 200 receives strip 12. Incision 25 of slip 12 receives a segment 222 of slip 190 forming a wedge-type joint for tightly anchoring strip 12 within orifice 209 of cap 200.

Referring now to FIGS. 33A through 33C, shown is base component 230. Base component 230 defines top surface 232, bottom surface 234, first side 236, second side 238, first end 240, and second end 242. Base component 230 defines a plurality of orifices 244 that pass through base component 230 from top surface 232 to bottom surface 234 and a plurality of orifices 245 that pass through base component 230 from first side 236 to second side 238. Base component 230 also preferably defines orifices 246 in first end 240 and second end 242 that pass through to the nearest orifice 244 or 245.

Orifices 245 are sized to receive thickness 24 of first strip 12 for facilitating a side-by-side assembly of a plurality of base components 230 into platform 250, as shown in FIGS. 34A and 34B. First end 29 of first strip 12 may be received in one of orifices 244 of one of base components 230 and second end 30 of first strip 12 may be received in one of orifices 244 of another of base components 230. Alternatively, first end 29 of first strip 12 may be received in one of orifices 244 of base components 230 and extend perpendicular to or vertically outwardly from base component 230.

Referring now to FIGS. 35A and 35B, orifice 246 of first base component 230 is preferably sized to receive first end 254 of segment 252 30 of first strip 12. Second end 256 of segment 252 of first strip 12 may be received in orifice 246 of second base component 230, the two base components 230 in an end-to-end configuration as shown in FIG. 35B.

Referring now to FIGS. 36A through 36D, first strip 12 may be received in one of orifices 244 of base component 230 and held frictionally secure but rotatable around its longitudinal axis by a user applying a force with easy effort (e.g. approximately 30 newtons for strips with width 18 less than approximately 2 centimeters; other forces are contemplated as being effective for strips having other dimensions). Likewise, second strip 14 may be received in one of orifices 245 of base component 230 and held frictionally secure but rotatable around its longitudinal axis by a user applying a force with easy effort. Referring now to FIGS. 36A and 36B, first strip 12 may be located in orifice 244 with its side edges 22 and 26 oriented parallel to the plane of edges 236 and 238 of base element 230. Second strip 14 may be located vertically in orifice 245. In this configuration strip 12 and strip 14 do not engage one another. Referring now to FIGS. 36C and 36D, second strip 14 may be rotated to be located horizontally in orifice 245. In this configuration, strip 12 and strip 14 engage one another and both are held in place by friction. Alternatively, second strip 14 may be located vertically in orifice 245, and first strip 12 may be rotated to be located in orifice 244 with its side edges 22 and 26 oriented perpendicular to the plane of edges 236 and 238 of base element 230. In this configuration, strip 12 and strip 14 engage one another and both are held in place by friction.

Referring now to FIGS. 37A and 37B, a collar component is shown. Collar component 300 defines inside surface 302, and outside surface 306. Collar component 300 defines length 308 and two end orifices 310. Strip 12 may be received in orifices 310 and held frictionally secure but may pass through orifices 310 with a force easily exerted by a user as shown in FIG. 36B.

Referring now to FIGS. 38A, 38B and 38C, longer collar component 320 is shown. Longer collar component defines inside surface 322 and outside surface 326. Longer collar component 320 defines length 328 and two end orifices 330. Longer collar component 320 defines at least two perimeter orifices 334 although other numbers of perimeter orifices are possible. Strip 12 may be received in orifices 330 and held frictionally secure but may pass through orifices 330 with a force easily exerted by a user as shown in FIG. 38B. Alternately as shown in FIG. 38C, strip 12 may be received in one end orifice 330 of longer collar component 320 and held frictionally secure. Strip 14 may be received in the opposite end orifice 330 and held frictionally secure. A third strip 96 may be received in a pair of perimeter orifices 334 in longer collar component 320 and held frictionally secure, perpendicular to strip 12 and strip 14.

From the above disclosed embodiments, it can be seen that combinations of various ring types and sizes may be combined in many ways with different numbers and lengths of strips. Further, it can be seen that strips may be sized as desired for use in any of the above-referenced combinations. Example constructions may be seen in examples of construction toy assemblies shown in FIGS. 39-50.

In one embodiment, an assembled figurine may be provided, as shown in FIGS. 39-46, that may be constructed of some of the previously discussed components and may include additional components.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A construction toy comprising:

a first strip and a second strip, said first strip and said second strip having a top surface defining a width, a bottom surface defining said width, a first edge defining a thickness, a second edge defining said thickness, a length, and four longitudinal edges, said first strip and said second strip having a first end and a second end;

a ring defining a longitudinal axis, an inside surface and an outside surface, said ring having at least two perimeter orifices, said perimeter orifices sized to loosely receive one of said first strip and said second strip, said perimeter orifices sized to receive said first strip and said second strip stacked together and held in place by friction.

2. The construction toy according to claim 1 wherein:

said first strip and said second strip define a plurality of scores on said top surface, said scores for facilitating breakage of said first strip and said second strip at a selected one of said scores.

3. The construction toy according to claim 1 wherein:

said first strip and said second strip are bendable into a curved orientation.

4. The construction toy according to claim 1 wherein:

said first strip and said second strip and/or said ring are comprised of bamboo.

5. The construction toy according to claim 1 wherein:

a radius of said orifice is related to the thickness of said first strip and said second strip according to the equation: $r=\sqrt{((Sw^2+(2St)^2)/4)}-q$;

wherein Sw is defined as the width of the strips, St is defined as the thickness of the strips and is bounded by zero and Sw ($0<St<Sw$), and q is defined as the compression of longitudinal edges of the strips when the strips are stacked together inside a pair of orifices.

6. The construction toy according to claim 1 wherein:

at least one of said first strip and said second strip define a fork in at least one of said first end and said second end, said fork sized to receive string.

7. The construction toy according to claim 1 wherein:

said at least two perimeter orifices of said ring is at least four perimeter orifices.

8. The construction toy according to claim 7 wherein:

wherein said four perimeter orifices are centered on a radial plane of said ring, wherein said four perimeter orifices comprise a first pair of orifices and a second pair of orifices.

9. The construction toy according to claim 8 wherein:

wherein said first strip is placed in said first pair of said orifices;

said second strip is placed in said second pair of orifices;

said first strip engages said second strip inside of said ring, wherein said first strip and said second strip are held in place by frictionally engaging one another.

10. The construction toy according to claim 1 wherein:

an interior wall oriented normal to said longitudinal axis is within said inside surface of said ring, said interior wall defining an orifice;

said orifice receiving said first strip defining said first fork;

a slip received in said first fork for retaining said ring on said first strip.

11. The construction toy according to claim 1 further comprising:

base components, said base components having a top surface and bottom surface defining a thickness therebetween, a right side and a left side defining a width therebetween and a first end and a second end defining a length therebetween, said base components defining a plurality of top orifices, a right orifice defined by said right side, a left orifice defined by a left side, and a first end orifice defined by said first end and a second end orifice defined by said second end;

said orifices sized to receive said first strip or said second strip for holding said strips in place by friction.

12. The construction toy according to claim 11 wherein:

a base unit offset distance is defined as the shortest distance between the axis that passes through the center of a said left orifice and said right orifice and is perpendicular to said length of said base unit and the axis that passes through the center of a nearest axis of said top orifice and is perpendicular to said length of said base unit; and, wherein horizontally is defined as an orientation wherein said top and bottom surface of said strips are oriented parallel to the plane of said top and bottom surface of said base unit and wherein vertically is defined as an orientation wherein said top and bottom surface of said strips are orientated perpendicular to the plane of said top and bottom surface of said base unit; and, wherein said left and right orifices are offset from said top orifices by a minimum base unit offset distance necessary for a user applying a force with easy effort to rotate a second strip positioned vertically in said right orifice and said left orifice so as to be positioned horizontally while a first strip is positioned in the nearest said top orifice with its said top and bottom surface perpendicular to the plane of said right and left side of said base unit.

13. The construction toy according to claim 11 wherein:

when said second strip is positioned horizontally in a said right orifice and said left orifice while said first strip is positioned in the nearest said top orifice with said top and bottom surface of said second strip perpendicular to a plane of said right side and a plane of said left side of said base unit, said first strip and said second strip engage one another inside of said base unit and are held in place by frictionally engaging one another; and when said second strip is positioned vertically in a said left orifice and said right orifice while said first strip is positioned in a nearest said top orifice with said top and bottom surface of said first strip parallel to a plane of said right side and a plane of said left side of said base unit, said first strip and said second strip engage one another inside of said base unit and are held in place by frictionally engaging one another.

14. A construction toy comprising:

a first strip and a second strip, said first strip and said second strip having a top surface defining a width, a bottom surface defining said width, a first edge defining a thickness, a second edge defining said thickness, a length, and four longitudinal edges, said first strip and said second strip having a first end and a second end;

a ring defining a longitudinal axis, an inside surface and an outside surface, said ring having at least two perimeter orifices, said perimeter orifices sized to loosely receive one of said first strip and said second strip, said perimeter orifices sized to receive said first strip and said second strip stacked together and held in place by friction;

said at least two perimeter orifices of said ring is at least four perimeter orifices;

an offset distance is defined as ±10% of the value obtained by $$O=\sqrt{((4((r+q)^2)-(2St)^2)+St^2)}-(r+q)-(\delta^H+\delta^V);\text{ and}$$

wherein said four perimeter orifices comprise a first pair of orifices and a second pair of orifices, wherein said first pair of orifices are offset from said second pair of orifices by said offset distance along said longitudinal axis of said ring;

wherein horizontally is defined as an orientation wherein said width of said first strip and said second strip are oriented normal to said longitudinal axis of said ring and wherein vertically is defined as an orientation wherein said width of said first strip or said second strip is orientated parallel to said longitudinal axis;

wherein r is the radius of said orifices, q is defined as the compression of corners of the strips along radius r, St is the thickness of the strips and $\delta^H$ and $\delta^V$ are defined as deflection of first strip and second strip, respectively, from their rest position.

15. The construction toy according to claim 14 wherein: said offset distance is ±5% of the value of O.

16. The construction toy according to claim 14 wherein:

when said first strip is located horizontally in said first pair of orifices and said second strip is located horizontally in said second pair of orifices, said first strip is slidable within said first pair of orifices and said second strip is slidable within said second pair of orifices; and when said first strip is located horizontally in said first pair of orifices and said second strip is located vertically in said second pair of orifices, said first strip and said second strip held in place by frictionally engaging one another.

17. The construction toy according to claim 14 wherein:

an offset distance is defined as ±10% of the value obtained by $$O=2\sqrt{((4((r+q)^2)-(2St)^2)+St^2)}-(r+q)-2\delta^V;\text{ and}$$

wherein said four perimeter orifices comprise a first pair of orifices and a second pair of orifices, wherein said first pair of orifices are offset from said second pair of orifices by said offset distance along said longitudinal axis of said ring;

wherein horizontally is defined as an orientation wherein said width of said first strip and said second strip is oriented normal to said longitudinal axis of said ring and wherein vertically is defined as an orientation wherein said width of said first strip and said second strip is orientated parallel to said longitudinal axis;

wherein r is the radius of the orifices, q is defined as the compression of corners of the strips along radius r, St is the thickness of the strips and $\delta^V$ is defined as the deflection of said first strip and said second strip from their rest position.

18. The construction toy according to claim 17 wherein:

said first strip is slidable with said first pair of orifices and said second strip is slidable within said second pair of orifices;

wherein when said first strip is located horizontally in said first pair of orifices and said second strip is located vertically in said second pair of orifices, said first strip is slidable within said first pair of orifices and said second strip is slidable within said second pair of orifices frictionally engaging one another;

wherein when said first strip is located vertically in said first pair of orifices and said second strip is located vertically in said second pair of orifices, said first strip, said second strip are held in place by friction.

19. The construction toy according to claim 14 wherein:

an offset distance is defined as ±10% of the value obtained by $$O=2(\sqrt{((4((r+q)^2)-(2St)^2)+St^2)}-r);\text{ and}$$

wherein said four perimeter orifices comprise a first pair of orifices and a second pair of orifices, wherein said first pair of orifices are offset from said second pair of orifices by an amount greater or equal to said offset distance along said longitudinal axis;

wherein horizontally is defined as an orientation wherein said width of said strips are oriented normal to said longitudinal axis of said ring and wherein vertically is defined as an orientation wherein said width of said strips is orientated parallel to said longitudinal axis;

wherein r is the radius of orifices, q is defined as the compression of corners of the strips along radius r, and St is the thickness of the strips.

20. The construction toy according to claim 19 wherein:

wherein when said first strip is located vertically in said first pair of orifices and said second strip located vertically in said second pair of orifices, said first strip and said second strip are rotatable within said orifices;

wherein when said first strip and said second strip are stacked and received horizontally in said first pair of orifices and a third strip is received vertically in said second pair of orifices, said third strip is rotatable within said second pair of orifices;

wherein when said first strip and said second strip are stacked and received horizontally in said first pair of orifices and a third strip and a fourth strip are stacked and received horizontally in said second pair of orifices, said first strip and said second strip are held by frictional engagement within said first pair of orifices and said stacked third strip and said fourth strip are held by frictional engagement within said second pair of orifices.

* * * * *